US007849972B2

(12) United States Patent
Higashinaka

(10) Patent No.: US 7,849,972 B2
(45) Date of Patent: Dec. 14, 2010

(54) EMERGENCY STOP DEVICE OF ELEVATOR

(75) Inventor: Tsunehiro Higashinaka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 833 days.

(21) Appl. No.: 10/578,174

(22) PCT Filed: May 25, 2004

(86) PCT No.: PCT/JP2004/007454

§ 371 (c)(1),
(2), (4) Date: May 4, 2006

(87) PCT Pub. No.: WO2005/115904

PCT Pub. Date: Dec. 8, 2005

(65) Prior Publication Data

US 2007/0170010 A1 Jul. 26, 2007

(51) Int. Cl.
*B66B 5/16* (2006.01)

(52) U.S. Cl. ..... 187/351; 187/286; 187/359; 187/373; 187/374

(58) Field of Classification Search ..... 187/351, 187/359, 373, 374, 286
See application file for complete search history.

(56) References Cited

U.S. PATENT DOCUMENTS

| | | | | |
|---|---|---|---|---|
| 1,764,303 | A | 6/1930 | Higbee | |
| 2,511,697 | A | 6/1950 | Clift | |
| 3,768,597 | A * | 10/1973 | Darwent et al. | 187/376 |
| 5,033,587 | A * | 7/1991 | Nakai et al. | 187/289 |
| 5,234,079 | A * | 8/1993 | Nomura | 187/250 |
| 5,366,045 | A * | 11/1994 | Liston | 187/376 |
| 5,518,087 | A * | 5/1996 | Hwang et al. | 187/374 |
| 5,782,319 | A * | 7/1998 | Woodruff et al. | 187/376 |
| 6,173,813 | B1 * | 1/2001 | Rebillard et al. | 187/287 |
| 6,318,505 | B1 * | 11/2001 | De Angelis | 187/292 |
| 2004/0112683 | A1 * | 6/2004 | Liebetrau et al. | 187/372 |
| 2004/0178023 | A1 * | 9/2004 | Maury | 187/373 |

FOREIGN PATENT DOCUMENTS

| | | | |
|---|---|---|---|
| JP | 54-144649 | | 11/1979 |
| JP | 62-167187 | | 7/1987 |
| JP | 4-66491 | | 3/1992 |
| JP | 4-75985 | | 3/1992 |
| JP | 06032548 | A * | 2/1994 |
| JP | 10-139303 | | 5/1998 |
| JP | 11124281 | A * | 5/1999 |
| JP | 2001-080840 | | 3/2001 |

* cited by examiner

*Primary Examiner*—Walter Benson
*Assistant Examiner*—Kawing Chan
(74) *Attorney, Agent, or Firm*—Oblon, Spivak, McClelland, Maier & Neustadt, L.L.P.

(57) ABSTRACT

In an emergency brake device for an elevator, a pair of pivot levers are pivotably provided to a car. Each pivot member is provided with each of a plurality of wedges that can be brought into and out of contact with a car guide rail as the pivot member pivots. A connecting member is connected between the pivot levers. The car is mounted with an electromagnetic actuator for displacing the connecting member in a reciprocating manner so as to pivot the pivot levers in a direction for bringing each wedge into and out of contact with the car guide rail. The electrical actuator is actuated when inputted with an actuating signal from an output portion mounted in a control panel.

13 Claims, 21 Drawing Sheets

EMERGENCY STOP DEVICE OF ELEVATOR

TECHNICAL FIELD

The present invention relates to a safety device for an elevator for preventing an elevator car that is raised and lowered in a hoistway from falling.

BACKGROUND ART

JP 2001-80840 A discloses a safety device for an elevator in which a wedge is pressed against a car guide rail for guiding an elevator car to thereby stop falling of the car. In the conventional safety device for an elevator, a governor is used to detect an abnormality in the speed of the car being raised and lowered. A governor rope that moves in synchronism with the raising and lowering of the car is wound around a sheave of the governor. The car is mounted with a safety link connected to the governor rope, and the wedge operatively coupled to the safety link. The governor detects a speed abnormality when the speed of the car exceeds a rated speed, and clamps a governor rope. The clamping of the governor rope by the governor actuates the safety link, thereby pressing the wedge against the car guide rail. The braking force generated by the pressing prevents the car from falling.

In the elevator apparatus as described above, however, such actions as the clamping of the governor rope and the actuation of the safety link intervene between the detection of the car speed abnormality by the governor and the generation of the braking force by the wedge. Accordingly, due to, for example, a delay in the clamping operation of the governor rope by the governor, expansion/contraction of the governor rope, and a delay in the actuation of the safety link, it takes a while until the braking force is generated after the detection of the car speed abnormality. Therefore, at the time the braking force is generated, the speed of the car has already become high, leading to an increase in the resulting impact on the car. Further, the braking distance the car travels until it comes to a stop also increases.

DISCLOSURE OF THE INVENTION

The present invention has been made to solve the above-mentioned problems, and therefore it is an object of the present invention to provide an elevator apparatus capable of reducing the braking distance a car travels until it comes to a stop and applying braking to the car in a stable manner.

A safety device for an elevator according to the present invention includes: a pair of pivot levers provided to a car guided by a guide rail, the pair of pivot levers being pivotable about a pair of pivot shafts that are parallel to each other; a plurality of braking members each provided to each of the pivot levers, the plurality of braking members being capable of coming into and out of contact with the guide rail through pivotal movement of the pivot levers; a connecting member connected between the pivot levers; and an electromagnetic actuator for causing the connecting member to undergo reciprocating displacement to pivot the pivot levers in a direction for bringing the braking members into and out of contact with the guide rail.

BEST MODE FOR CARRYING OUT THE INVENTION

Herein below, preferred embodiments of the present invention will be described with reference to the drawings.

Embodiment 1

Figure 1:
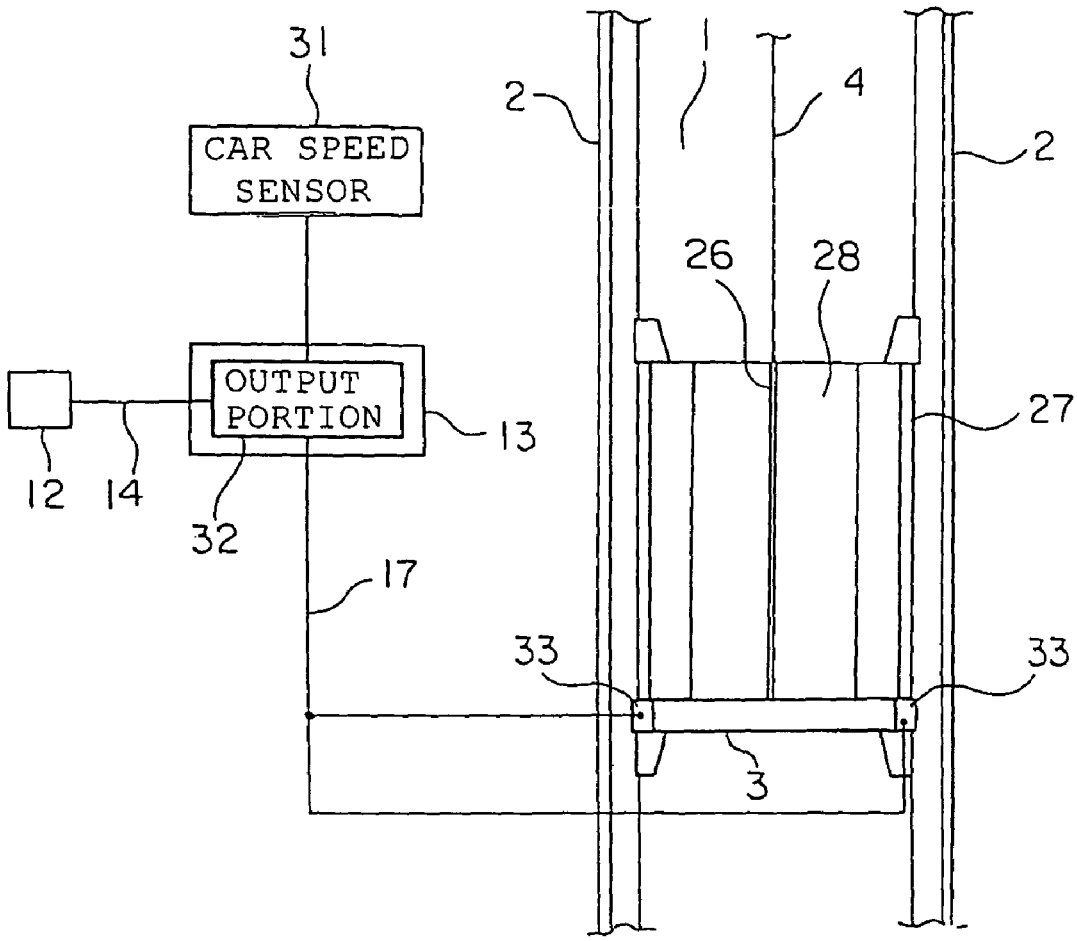
FIG. 1 is a schematic diagram showing an elevator apparatus according to Embodiment 1 of the present invention.

FIG. 1 is a schematic diagram showing an elevator apparatus according to Embodiment 1 of the present invention. Referring to the drawing, a pair of car guide rails 2 are disposed in a hoistway 1. A car 3 is raised and lowered in the hoistway 1 while being guided by the car guide rails 2. A hoisting machine (not shown) for raising and lowering the car 3 and a counterweight (not shown) is arranged at an upper end portion of the hoistway 1. Main ropes 4 are wound around a driving sheave of the hoisting machine. The car 3 and the counterweight are suspended in the hoistway 1 by the main ropes 4. The car 3 is mounted with a safety device 33 serving as braking means for preventing the car 3 from falling. The safety device 33 is arranged in a lower portion of the car 3. Braking is applied to the car 3 upon actuating the safety device 33.

The car 3 has a car main body 27 provided with a car entrance 26, and a car door 28 for opening and closing the car entrance 26. In the hoistway 1, there are provided a car speed sensor 31 as car speed detecting means for detecting the speed of the car 3, and a control panel 13 for controlling the operation of the elevator.

The control panel 13 has mounted therein an output portion 32 electrically connected to the car speed sensor 31. A battery 12 is connected to the output portion 32 through a power cable 14. Electric power for detecting the speed of the car 3 is supplied from the output portion 32 to the car speed sensor 31. A speed detection signal is inputted to the output portion 32 from the car speed sensor 31.

A control cable (movable cable) is connected between the car 3 and the control panel 13. The control cable includes, in addition to a plurality of power lines and signal lines, an emergency stop wiring 17 that is electrically connected between the control panel 13 and the safety device 33.

A first overspeed set to a value larger than the normal running speed of the car 3, and a second overspeed set to a value larger than the first overspeed, are set in the output portion 32. When the speed of the car 3 being raised and lowered reaches the first overspeed (set overspeed), the output portion 32 causes a brake device of the hoisting machine to be actuated, and when the speed reaches the second overspeed, the output portion 32 outputs electric power stored in, for example, a condenser in the form of an actuating signal to the safety device 33. The safety device 33 is actuated upon the inputting of the actuating signal.

Figure 2:
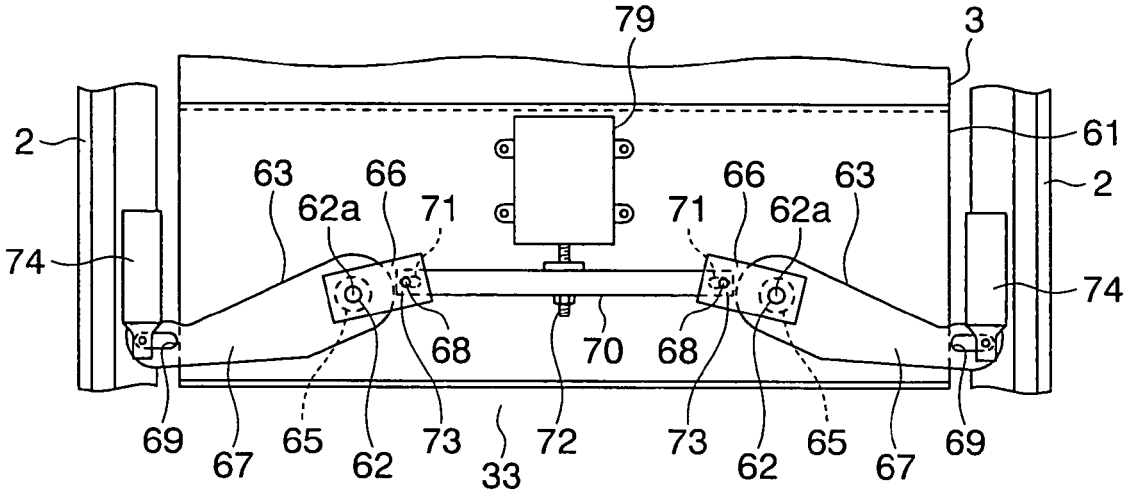
FIG. 2 is a front view showing the safety device of FIG. 1.
Figure 3:
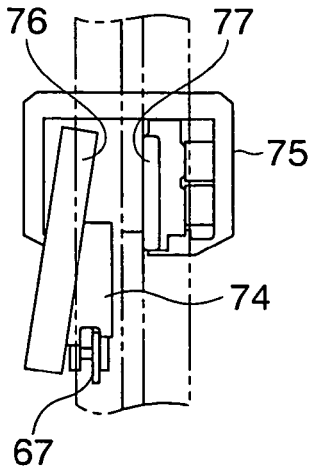
FIG. 3 is a side view showing the safety device of FIG. 2.
Figure 4:
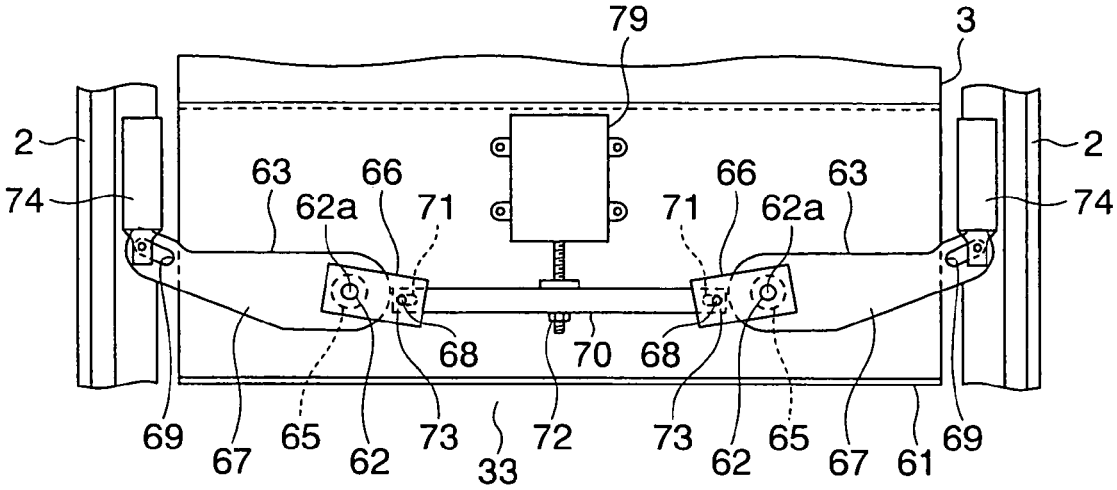
FIG. 4 is a front view showing the safety device of FIG. 2 in an actuated state.
Figure 5:
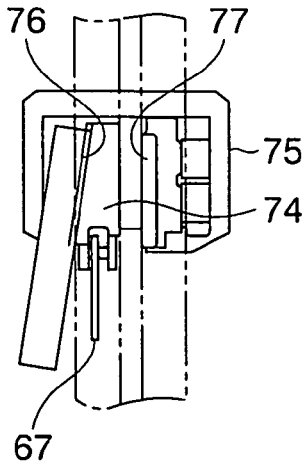
FIG. 5 is a side view showing the safety device of FIG. 4.

FIG. 2 is a front view showing the safety device 33 of FIG. 1, and FIG. 3 is a side view showing the safety device 33 of FIG. 2. Further, FIG. 4 is a front view showing the safety device 33 of FIG. 2 in an actuated state, and FIG. 5 is a side view showing the safety device 33 of FIG. 4. Referring to the drawings, fixed to a lower portion of the car 3 is an emergency stop frame 61 as a support member for supporting the safety device 33.

A pair of pivot shafts 62 having horizontal axes 62*a* extending in parallel with each other are pivotably provided to the emergency stop frame 61. The pivot shafts 62 are arranged while being spaced apart from each other in the horizontal direction. Each pivot shaft 62 is provided with a pivot lever 63 that is pivotable integrally with each pivot shaft 62. Further, the pivot shafts 62 and the pivot levers 63 are arranged symmetrically with respect to the center line of the emergency stop frame 61.

Figure 6:
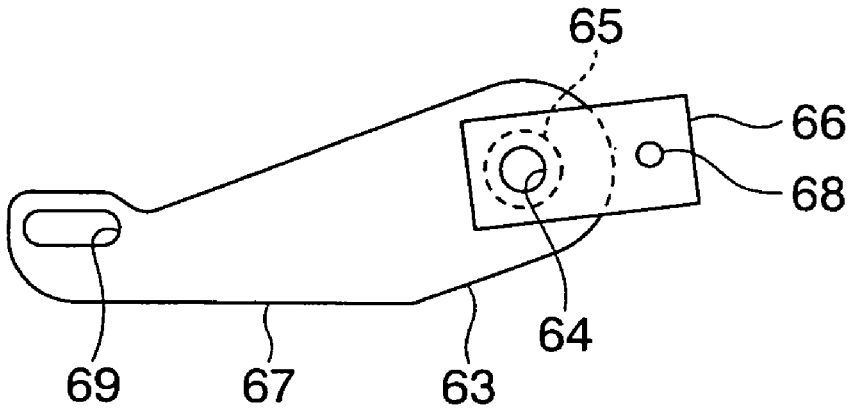
FIG. 6 is a front view showing the pivot lever of FIG. 2.
Figure 7:
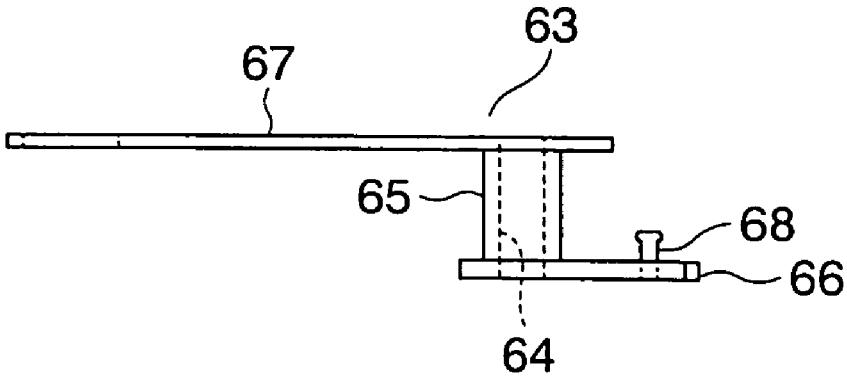
FIG. 7 is a plan view showing the pivot lever of FIG. 6.

Now, FIG. 6 is a front view showing the pivot lever 63 of FIG. 2, and FIG. 7 is a plan view showing the pivot lever 63 of FIG. 6. As shown in FIGS. 6, 7, each pivot lever 63 has: a boss 65 provided with a through-hole through which the pivot shaft 62 is passed; an extending portion 66 extending from one end portion of the boss 65 to the central portion side of the emergency stop frame 61; and an arm portion 67 extending from the other end portion of the boss 65 to the car guide rail 2 side. Each pivot shaft 62 is passed through each through-hole 64 and fixed to the boss 65 by welding or the like.

A projecting portion 68 is provided to the distal end portion of each extending portion 66. Each projecting portion 68 is slidably fitted in each of a pair of elongated holes 71 provided at the opposite end portions of a bar-like connecting member (connecting bar) 70 connecting the extending portions 66 to each other. That is, the connecting member 70 is slidably connected between the distal end portions of the respective extending portions 66. It should be noted that each elongated hole 71 extends in the longitudinal direction of the connecting member 70. Further, a connecting portion 73 of the connecting member 70 with each extending portion 66 is composed of each projecting portion 68 and each elongated hole 71.

The connecting member 70 is capable of reciprocating displacement in the direction perpendicular (the vertical direction in this example) to the plane containing each horizontal axis 62*a*. Further, the connecting member 70 is arranged in parallel with the plane containing each horizontal axis 62*a*. The respective connecting portions 73 are arranged on the same side with respect to the plane containing each horizontal axis 62*a*. Each pivot lever 63 is pivoted about the horizontal axis 62*a* through the vertical reciprocating displacement of the connecting member 70.

An elongated hole 69 is provided in the distal end portion of each arm portion 67. Slidably fitted in each elongated hole 69 is a wedge 74 serving as a braking member capable of coming into and out of contact with the car guide rail 2. Each wedge 74 is vertically displaced as the pivot lever 63 pivots. Provided above each wedge 74 is a gripper metal 75 (see FIGS. 3, 5) serving as a guide portion for guiding the wedge 74 into and out of contact with the car guide rail 2. Each gripper metal 75 is fixed to either end portion of the emergency stop frame 61.

Each gripper metal 75 has an inclined portion 76 and a contact portion 77 provided so as to pinch the car guide rail 2. The wedge 74 is provided so as to be slidable on the inclined portion 76. As it is displaced upwards with respect to the gripper metal 75, each wedge 74 is wedged in between the inclined portion 76 and the car guide rail 2. Accordingly, the car guide rail 2 is pinched by the wedge 74 and the contact portion 77, thereby applying braking to the car 3. Further, as it is displaced downwards with respect to the gripper metal 75, each wedge 74 is separated from the car guide rail 2. The braking on the car 3 is thus released.

Provided at the central portion of the emergency stop frame 61 is an electromagnetic actuator 79 for vertically reciprocating and displacing the connecting member 70. The electromagnetic actuator 79 is arranged above the connecting member 70. Connected to the central portion of the connecting member 70 is a movable shaft 72 extending downwards from a lower portion of the electromagnetic actuator 79.

The movable shaft 72 undergoes reciprocating displacement between a retracted position (FIG. 2) where the movable shaft 72 is retracted to the electromagnetic actuator 79 side through the drive of the electromagnetic actuator 79, and an advanced position (FIG. 4) located below the retracted position and where the movable shaft 72 is advanced from the electromagnetic actuator 79 side. As the movable shaft 72 is displaced into the retracted position, the connecting member 70 is displaced into a normal position (FIG. 2) where each wedge 74 is separated from the car guide rail 2, and as the movable shaft 72 is displaced into the advanced position, the connecting member 70 is displaced into an actuating position (FIG. 4) where each wedge 74 is wedged in between the inclined portion 76 and the car guide rail 2.

Figure 8:
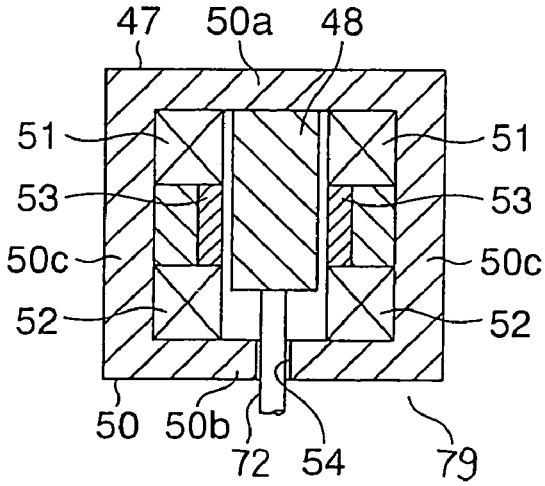
FIG. 8 is a sectional view showing the electromagnetic actuator of FIG. 2.
Figure 9:
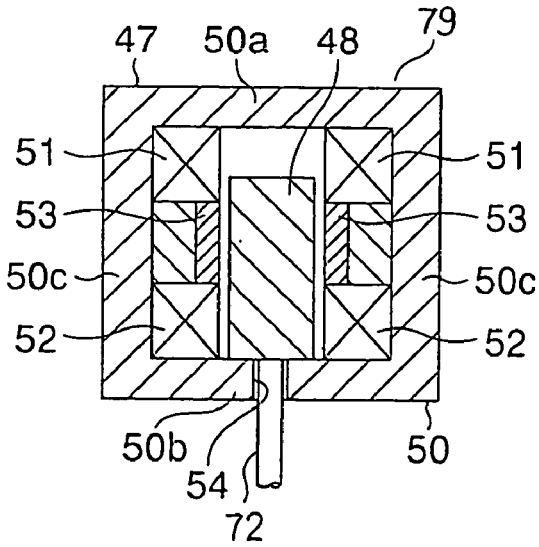
FIG. 9 is a sectional view showing the electromagnetic actuator of FIG. 4.

FIG. 8 is a sectional view showing the electromagnetic actuator 79 of FIG. 2. Further, FIG. 9 is a sectional view showing the electromagnetic actuator 79 of FIG. 4. Referring to the drawings, the electromagnetic actuator 79 has an actuator main body 47, and a movable iron core 48 displaced through the drive of the actuator main body 47. The movable iron core 48 is accommodated inside the actuator main body 47. The movable shaft 72 extends from the movable iron core 48 to the outside of the actuator main body 47.

The actuator main body 47 has: a stationary iron core 50 having a pair of regulating portions 50*a*, 50*b* for regulating the displacement of the movable iron core 48, and side wall portions 50*c* connecting the regulating portions 50*a*, 50*b* to each other, the stationary iron core portion 50 surrounding the movable iron core 48; first coils 51 accommodated inside the stationary iron core 50 and causing the movable iron core 48 to displace into contact with one regulating portion, the regulating portion 50*a*, when energized; second coils 52 accommodated inside the stationary iron core 50 and causing the movable iron core 48 to displace into contact with the other regulating portion, the regulating portion 50*b*, when energized; and annular permanent magnets 53 arranged between the first coil 51 and the second coil 52.

The other regulating portion 50*b* is provided with a through-hole 54 through which the connecting shaft 72 is passed. The movable iron core 48 is abutted against the one regulating portion 50*a* when the movable shaft 72 is in the retracted position, and is abutted against the other regulating portion 50*b* when the movable shaft 72 is in the advanced position.

The first coil 51 and the second coil 52 each consist of an annular electromagnetic coil surrounding the movable iron core 48. Further, the first coil 51 is arranged between the permanent magnet 53 and the one regulating portion 50*a*, and the second coil 51 is arranged between the permanent magnet 53 and the other regulating portion 50*b*.

In the state where the movable iron core 48 is abutted against the one regulating portion 50*a*, a space that acts as a magnetic resistance is present between the movable iron core 48 and the other regulating portion 50*b*. The amount of magnetic flux of the permanent magnet 53 thus becomes larger on the first coil 51 side than on the second coil 52 side, so the movable iron core 48 is held in abutment with the one regulating portion 50*a* as it is.

Further, in the state where the movable iron core 48 is abutted against the other regulating portion 50*b*, a space that acts as a magnetic resistance is present between the movable iron core 48 and the one regulating portion 50*a*. The amount of magnetic flux of the permanent magnet 53 thus becomes larger on the second coil 52 side than on the first coil 51 side, so the movable iron core 48 is retained in abutment against the other regulating portion 50*b*.

Electric power from the output portion 32 is inputted in the form of an actuating signal to the second coil 52. When inputted with the actuating signal, the second coil 52 generates a magnetic flux acting against the force for retaining the abutment of the movable iron core 48 against the one regulating portion 50*a*. Further, electric power from the output portion 32 is inputted to the first coil 51 in the form of a return signal. When inputted with the return signal, the first coil 51 generates a magnetic flux acting against the force for retaining the abutment of the movable iron core 48 against the other regulating portion 50*b*.

Next, operation will be described. During the normal operation, the movable shaft 72 and the connecting member 70 are displaced into the retracted position and the normal position, respectively. Each wedge 74 is separated from the car guide rail 2 in this state.

When the speed as detected by the car speed sensor 31 reaches the first overspeed, the brake device of the hoisting machine is actuated. When the speed of the car 3 continues to rise thereafter and the speed as detected by the car speed sensor 31 reaches the second overspeed, an actuating signal is outputted from the output portion 32 to the safety device 33. The actuating signal is inputted to the second coil 52, and as the movable shaft 72 is displaced from the retracted position into the advanced position, the connecting member 70 is displaced from the normal position into the actuating position located below the normal position. As a result, the pivot levers 63 are pivoted in opposite directions about the respective horizontal axes 62*a*, thereby pushing each wedge 74 upwards. Each wedge 74 is thus slid along the inclined portion 76 to be inserted between the inclined portion 76 and the car guide rail 2. Thereafter, each wedge 74 comes into contact with the car guide rail 2 and thus displaced further upwards with respect to the gripper metal 75 to be wedged in between the inclined portion 76 and the car guide rail 2. A large friction force is thus generated between the car guide rail 2 and each wedge 74, thereby braking the car 3.

When returning to the normal operation, a return signal is outputted from the output portion 32 to the safety device 33. The return signal is inputted to the first coil 51, and by an operation reverse to that described above, each wedge 74 is displaced downwards with respect to the gripper metal 75. Each wedge 74 is thus separated from the car guide rail 2 to thereby release the braking on the car 3.

In the safety device 33 for an elevator as described above, the pair of pivot levers 63 each having the wedge 74 fitted thereto are connected to each other by the connecting member 70, and the pivot levers 63 are pivoted simultaneously through the reciprocating displacement of the connecting member 70 by the electromagnetic actuator 79. Accordingly, the safety device 33 can be actuated by inputting an electrical actuating signal to the electromagnetic actuator 79, thereby making it possible to actuate the safety device 33 in a short time after the detection of an abnormality in the car 3. Therefore, the braking distance can be reduced for the car 3. Further, the plurality of wedges 74 can be displaced simultaneously by actuating one electromagnetic actuator 79, whereby the number of parts can be reduced to achieve a reduction in cost. Further, the displacements of the respective wedges 74 can be synchronized with ease, whereby the braking on the car 3 can be stabilized.

Further, the electromagnetic actuator 79 displaces the connecting member 70 in the direction perpendicular to the plane containing each horizontal axis 62*a*, whereby the pivot levers 63 can be arranged bilaterally symmetrical to each other to thereby facilitate the manufacture of the pivot levers 63. Further, the displacements of the respective wedges 74 can be synchronized with greater ease.

Figure 10:
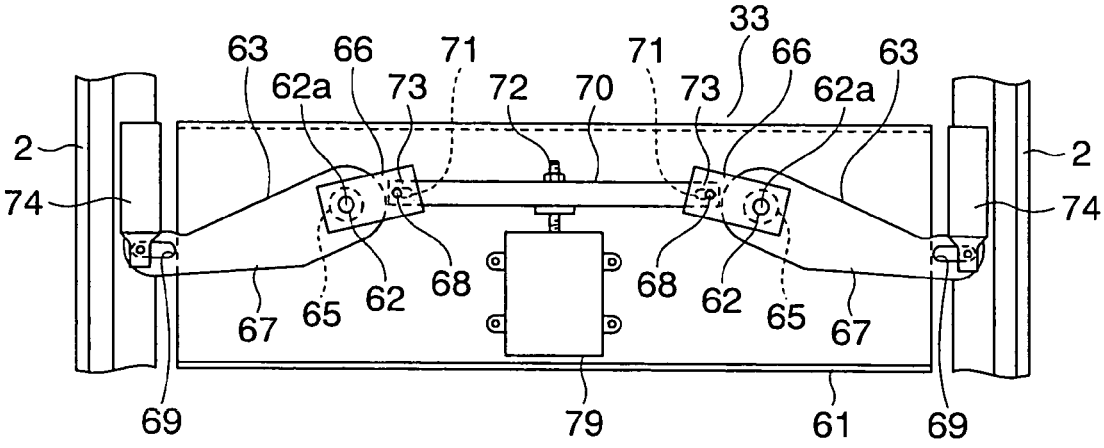
FIG. 10 is a front view showing another example of the safety device for an elevator according to Embodiment 1 of the present invention.

While in the above-described example the electromagnetic actuator 70 is arranged above the connecting member 70, as shown in FIG. 10, the electromagnetic actuator 70 may be arranged below the connecting member 70. In this case, the movable shaft 72 extends upwards from an upper portion of the electromagnetic actuator 79.

Embodiment 2

Figure 11:
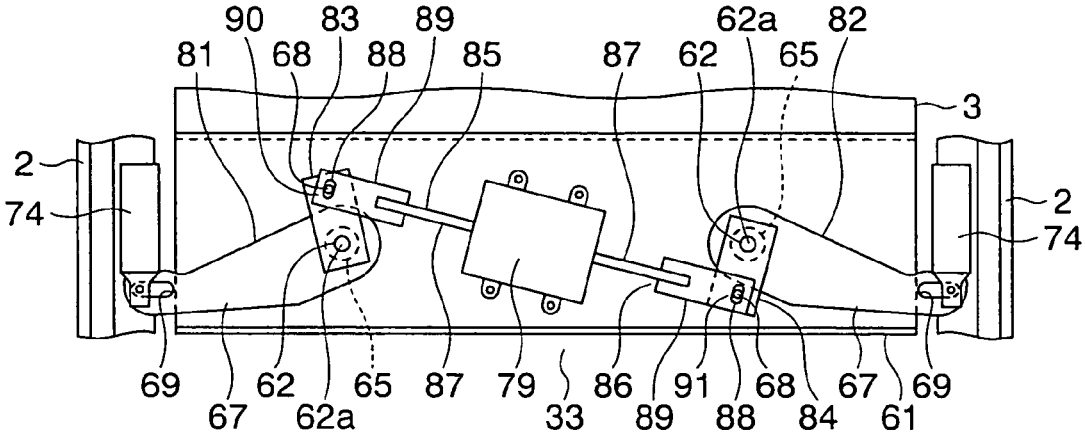
FIG. 11 is a front view showing a safety device for an elevator according to Embodiment 2 of the present invention.
Figure 12:
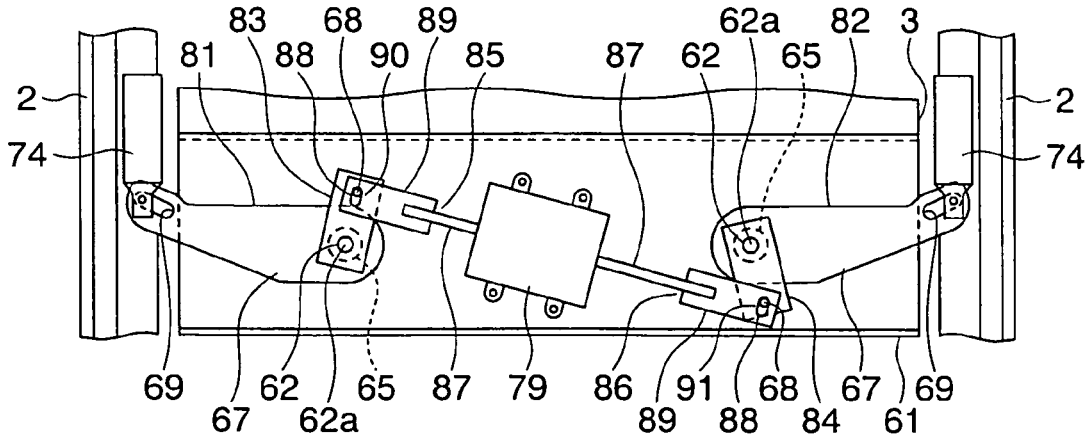
FIG. 12 is a front view showing the safety device of FIG. 11 in an actuated state.
Figure 13:
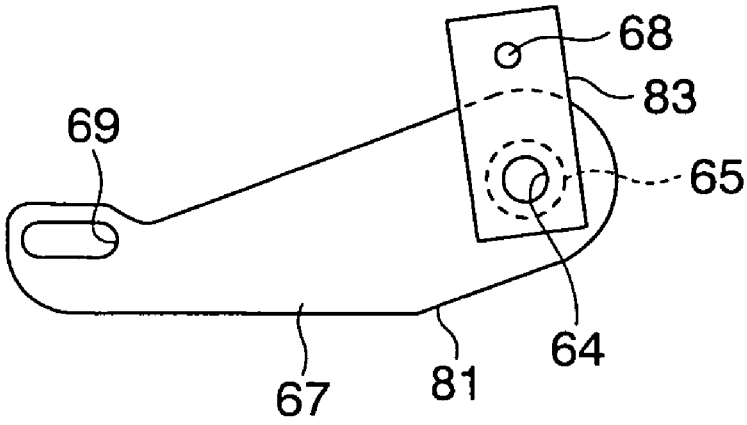
FIG. 13 is a front view showing one of pivot levers of FIG. 11.
Figure 14:
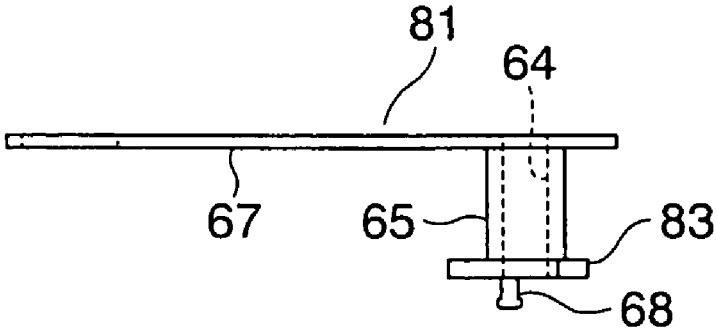
FIG. 14 is a plan view showing the pivot lever of FIG. 13.

FIG. 11 is a front view showing a safety device for an elevator according to Embodiment 2 of the present invention. Further, FIG. 12 is a front view showing the safety device of FIG. 11 in an actuated state. Referring to the drawings, a pair of pivot levers 81, 82 are fixed to the respective pivot shafts 62. As shown in FIGS. 13, 14, one pivot lever, the pivot lever 81, includes the boss 65 and the arm portion 67 that are the same as those of Embodiment 1, and an extending portion 83 extending upwards from an end portion of the boss 65. Further, the other pivot lever, the pivot lever 82, includes the boss 65 and the arm portion 67 that are the same as those of Embodiment 1, and an extending portion 84 extending downwards from an end portion of the boss 65. The respective bosses 65 and arm portions 67 of the one and the other pivot levers 81, 82 are arranged symmetrically with respect to the center line of the emergency stop frame 61.

The projecting portion 68 is provided in the distal end portion of each of the extending portion 83 and the extending portion 84. Connected to the respective projecting portions 68 are first and second movable members 85, 86 that are connecting members extending in opposite directions from the electromagnetic actuator 79. The first and second movable members 85, 86 are integrally reciprocated and displaced through the drive of the electromagnetic actuator 79. It should be noted that the electromagnetic actuator 79 is arranged between the pivot shafts 62.

Each of the first and second movable members 85, 86 has a movable shaft 87 extending from the electromagnetic actuator 79, and a fitting plate 89 fixed to the distal end portion of the movable shaft 87 and provided with an elongated hole 88. Each projecting portion 68 is slidably fitted in each elongated hole 88, and each elongated hole 88 and each projecting portion 68 constitute each of connecting portions 90, 91.

The first and second movable members 85, 86 are displaceable in the direction of the straight line connecting between the connecting portions 90, 91, that is, in the longitudinal direction. Further, the first and second movable members 85, 86 are arranged so as to be inclined with respect to the plane containing each horizontal axis 62*a*. Further, the connecting portions 90, 91 each are arranged on the different sides with respect to the plane containing each horizontal axis 62*a*. The pivot levers 81, 82 are pivoted about the horizontal axis 62*a* as the first and second movable members 85, 86 undergo reciprocating displacement in the longitudinal direction, respectively.

The first and second movable members 85, 86 undergo reciprocating displacement between a normal position (FIG. 11) where each wedge 74 is separated from the car guide rail 2 through the drive of the electromagnetic actuator 79, and an actuating position (FIG. 12) which is located on the other pivot lever 82 side with respect to the normal position and where each wedge 74 is wedged in between the inclined portion 76 and the car guide rail 2.

Figure 15:
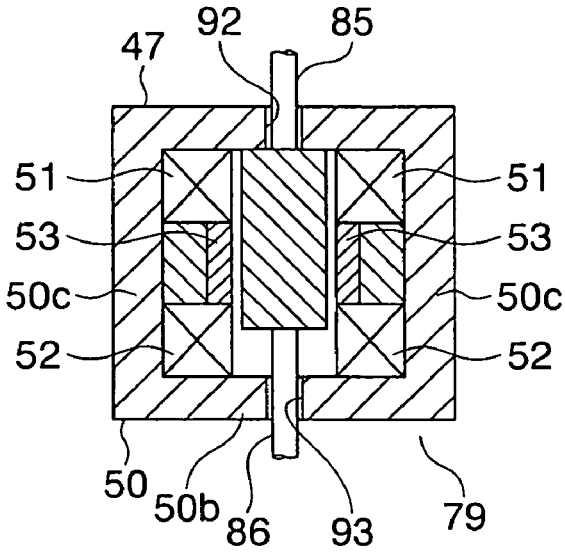
FIG. 15 is a sectional view showing the electromagnetic actuator of FIG. 11.
Figure 16:
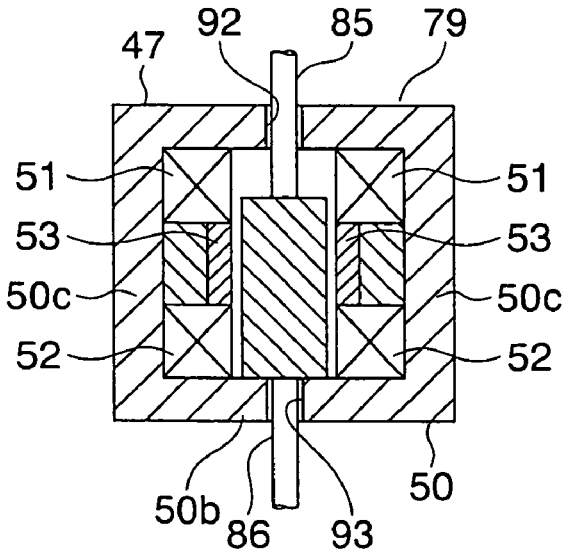
FIG. 16 is a sectional view showing the electromagnetic actuator of FIG. 12.

FIG. 15 is a sectional view showing the electromagnetic actuator 79 of FIG. 11, and FIG. 16 is a sectional view showing the electromagnetic actuator 79 of FIG. 12. Referring to the drawings, the first and second movable members 85, 86 are fixed to the movable iron core 48. That is, the first and second movable members 85, 86 and the movable iron core 48 are integrally displaceable. The regulating portion 50*a* is provided with a through-hole 92 through which the first movable member 85 is passed. Further, the regulating portion 50*b* is provided with a through-hole 93 through which the second movable member 86 is passed. The movable iron core 48 is abutted against the regulating portion 50*a* when the first and second movable members 85, 86 are in the normal position, and the movable iron core 48 is abutted against the regulating portion 50*b* when the first and second movable members 85, 86 are in the actuating position. Otherwise, Embodiment 2 is of the same construction as Embodiment 1.

Next, operation will be described. During the normal operation, the first and second movable members 85, 86 are displaced into the normal position. Each wedge 74 is separated from the car guide rail 2 in this state.

When an actuating signal from the output portion 32 is inputted to the second coil 52, the first and second movable members 85, 86 are displaced in the longitudinal direction from the normal position into the actuating position. The pivot levers 63 are thus pivoted about the horizontal axes 62*a* in opposite directions, thus pushing up the wedges 74. The subsequent operations are the same as described with reference to Embodiment 1.

When returning to the normal operation, a return signal is outputted from the output portion 32 to the safety device 33. The return signal is inputted to the first coil 51, and by an operation reverse to that described above, each wedge 74 is displaced downwards with respect to the gripper metal 75. Each wedge 74 is thus separated from the car guide rail 2 to thereby release the braking on the car 3.

In the safety device 33 for an elevator as described above, the electromagnetic actuator 79 causes the first and second movable members 85, 86 to undergo reciprocating displacement along the straight line connecting between the connecting portions 90, 91. Accordingly, the first and second movable members 85, 86 can be arranged along the line of action of the drive force from the electromagnetic actuator 79, whereby the requisite strength of the first and second movable members 85, 86 can be made smaller. The manufacturing cost of the first and second movable members 85, 86 can be thus reduced.

Further, as connecting members connecting between the extending portions 83, 84, the first and second movable members 85, 86 are caused to undergo reciprocating displacement by the electromagnetic actuator 79. Accordingly, the number of parts of the safety device 33 can be reduced to achieve a further reduction in manufacturing cost.

Embodiment 3

Figure 17:
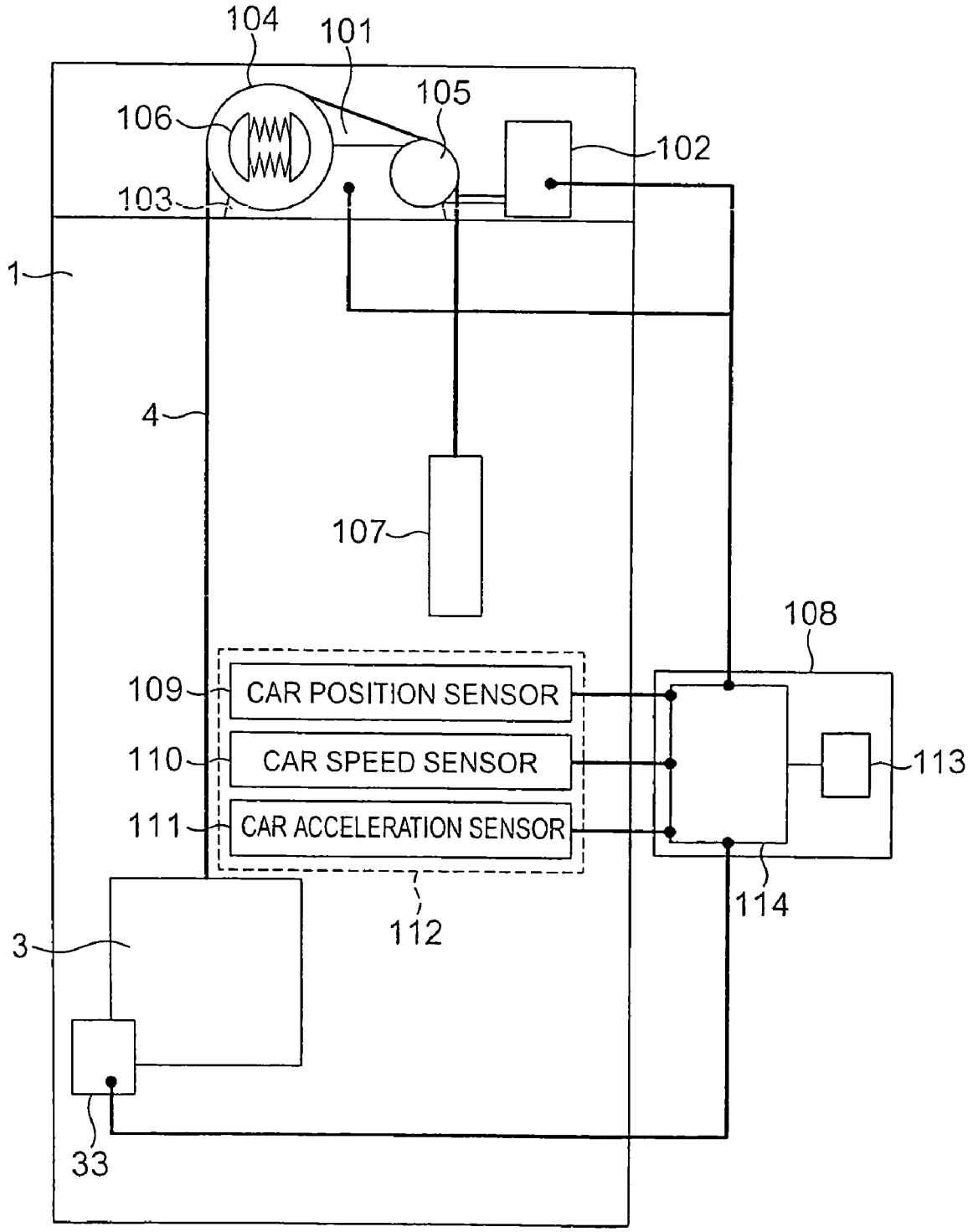
FIG. 17 is a schematic diagram showing an elevator apparatus according to Embodiment 3 of the present invention.

FIG. 17 is a schematic diagram showing an elevator apparatus according to Embodiment 3 of the present invention. In FIG. 17, a hoisting machine 101 serving as a driving device and a control panel 102 are provided in an upper portion within the hoistway 1. The control panel 102 is electrically connected to the hoisting machine 101 and controls the operation of the elevator. The hoisting machine 101 has a driving device main body 103 including a motor and a driving sheave 104 rotated by the driving device main body 103. A plurality of main ropes 4 are wrapped around the sheave 104. The hoisting machine 101 further includes a deflector sheave 105 around which each main rope 4 is wrapped, and a hoisting machine braking device (deceleration braking device) 106 for braking the rotation of the drive sheave 104 to decelerate the car 3. The car 3 and a counter weight 107 are suspended in the hoistway 1 by means of the main ropes 4. The car 3 and the counterweight 107 are raised and lowered in the hoistway 1 by driving the hoisting machine 101.

The safety device 33, the hoisting machine braking device 106, and the control panel 102 are electrically connected to a monitor device 108 that constantly monitors the state of the elevator. A car position sensor 109, a car speed sensor 110, and a car acceleration sensor 111 are also electrically connected to the monitor device 108. The car position sensor 109, the car speed sensor 110, and the car acceleration sensor 111 respectively serve as a car position detecting portion for detecting the speed of the car 3, a car speed detecting portion for detecting the speed of the car 3, and a car acceleration detecting portion for detecting the acceleration of the car 3. The car position sensor 109, the car speed sensor 110, and the car acceleration sensor 111 are provided in the hoistway 1.

Detection means 112 for detecting the state of the elevator includes the car position sensor 109, the car speed sensor 110, and the car acceleration sensor 111. Any of the following may be used for the car position sensor 109: an encoder that detects the position of the car 3 by measuring the amount of rotation of a rotary member that rotates as the car 3 moves; a linear encoder that detects the position of the car 3 by measuring the amount of linear displacement of the car 3; an optical displacement measuring device which includes, for example, a project or and a photo detector provided in the hoistway 1 and a reflection plate provided in the car 3, and which detects the position of the car 3 by measuring how long it takes for light projected from the projector to reach the photodetector.

The monitor device 108 includes a memory portion 113 and an output portion (calculation portion) 114. The memory portion 113 stores in advance a variety of (in this embodiment, two) abnormality determination criteria (set data) serving as criteria for judging whether or not there is an abnormality in the elevator. The output portion 114 detects whether or not there is an abnormality in the elevator based on information from the detection means 112 and the memory portion 113. The two kinds of abnormality determination criteria stored in the memory portion 113 in this embodiment are car speed abnormality determination criteria relating to the speed of the car 3 and car acceleration abnormality determination criteria relating to the acceleration of the car 3.

Figure 18:
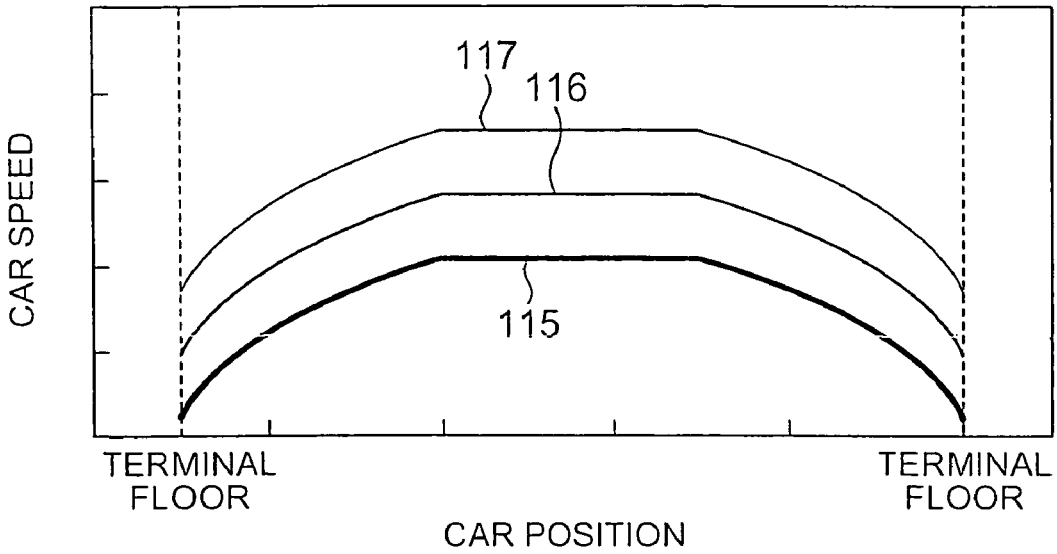
FIG. 18 is a graph showing the car speed abnormality determination criteria stored in the memory portion of FIG. 17.

FIG. 18 is a graph showing the car speed abnormality determination criteria stored in the memory portion 113 of FIG. 17. In FIG. 18, an ascending/descending section of the car 3 in the hoistway 1 (a section between one terminal floor and an other terminal floor) includes acceleration/deceleration sections and a constant speed section located between the acceleration/deceleration sections. The car 3 accelerates/decelerates in the acceleration/deceleration sections respectively located in the vicinity of the one terminal floor and the other terminal floor. The car 3 travels at a constant speed in the constant speed section.

The car speed abnormality determination criteria has three detection patterns each associated with the position of the car 3. That is, a normal speed detection pattern (normal level) 115 that is the speed of the car 3 during normal operation, a first abnormal speed detection pattern (first abnormal level) 116 having a larger value than the normal speed detection pattern 115, and a second abnormal speed detection pattern (second abnormal level) 117 having a larger value than the first abnormal speed detection pattern 116 are set, each in association with the position of the car 3.

The normal speed detection pattern 115, the first abnormal speed detection pattern 116, and a second abnormal speed detection pattern 117 are set so as to have a constant value in the constant speed section, and to have a value continuously becoming smaller toward the terminal floor in each of the acceleration and deceleration sections. The difference in value between the first abnormal speed detection pattern 116 and the normal speed detection pattern 115, and the difference in value between the second abnormal speed detection pattern 117 and the first abnormal speed detection pattern 116, are set to be substantially constant at all locations in the ascending/descending section.

Figure 19:
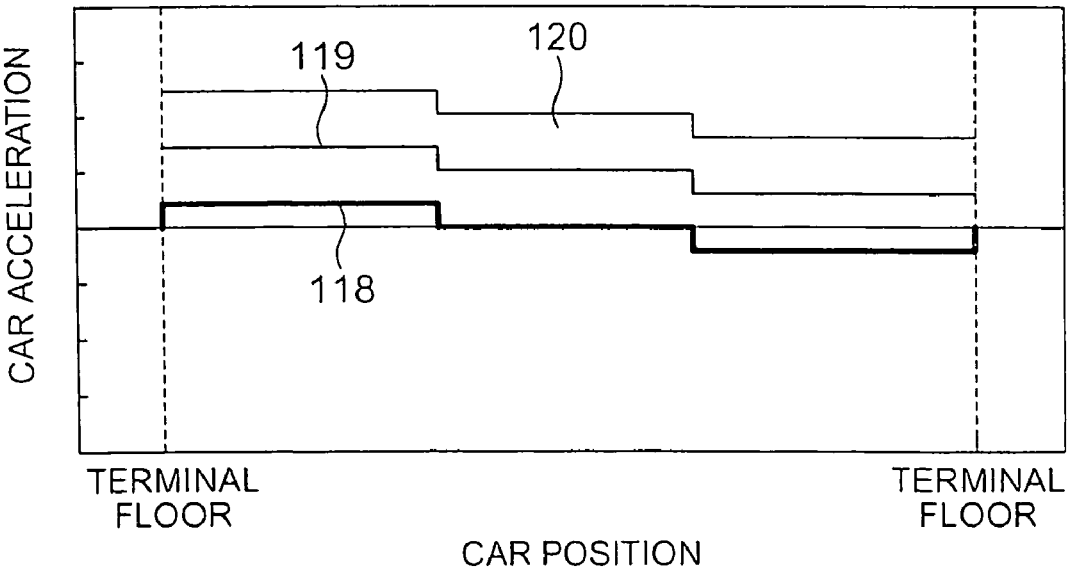
FIG. 19 is a graph showing the car acceleration abnormality determination criteria stored in the memory portion of FIG. 17.

FIG. 19 is a graph showing the car acceleration abnormality determination criteria stored in the memory portion 113 of FIG. 17. In FIG. 19, the car acceleration abnormality determination criteria has three detection patterns each associated with the position of the car 3. That is, a normal acceleration detection pattern (normal level) 118 that is the acceleration of the car 3 during normal operation, a first abnormal acceleration detection pattern (first abnormal level) 119 having a larger value than the normal acceleration detection pattern 118, and a second abnormal acceleration detection pattern (second abnormal level) 120 having a larger value than the first abnormal acceleration detection pattern 119 are set, each in association with the position of the car 3.

The normal acceleration detection pattern 118, the first abnormal acceleration detection pattern 119, and the second abnormal acceleration detection pattern 120 are each set so as to have a value of zero in the constant speed section, a positive value in one of the acceleration/deceleration section, and a negative value in the other acceleration/deceleration section. The difference in value between the first abnormal acceleration detection pattern 119 and the normal acceleration detection pattern 118, and the difference in value between the second abnormal acceleration detection pattern 120 and the first abnormal acceleration detection pattern 119, are set to be substantially constant at all locations in the ascending/descending section.

That is, the memory portion 113 stores the normal speed detection pattern 115, the first abnormal speed detection pattern 116, and the second abnormal speed detection pattern 117 as the car speed abnormality determination criteria, and stores the normal acceleration detection pattern 118, the first abnormal acceleration detection pattern 119, and the second abnormal acceleration detection pattern 120 as the car acceleration abnormality determination criteria.

The safety device 33, the control panel 102, the hoisting machine braking device 106, the detection means 112, and the memory portion 113 are electrically connected to the output portion 114. Further, a position detection signal, a speed detection signal, and an acceleration detection signal are input to the output portion 114 continuously over time from the car position sensor 109, the car speed sensor 110, and the car acceleration sensor 111. The output portion 114 calculates the position of the car 3 based on the input position detection signal. The output portion 114 also calculates the speed of the car 3 and the acceleration of the car 3 based on the input speed detection signal and the input acceleration detection signal, respectively, as a variety of (in this example, two) abnormality determination factors.

The output portion 114 outputs an actuation signal (trigger signal) to the hoisting machine braking device 106 when the speed of the car 3 exceeds the first abnormal speed detection pattern 116, or when the acceleration of the car 3 exceeds the first abnormal acceleration detection pattern 119. At the same time, the output portion 114 outputs a stop signal to the control panel 102 to stop the drive of the hoisting machine 101. When the speed of the car 3 exceeds the second abnormal speed detection pattern 117, or when the acceleration of the car 3 exceeds the second abnormal acceleration detection pattern 120, the output portion 114 outputs an actuation signal to the hoisting machine braking device 106 and the safety device 33. That is, the output portion 114 determines to which braking means it should output the actuation signals according to the degree of the abnormality in the speed and the acceleration of the car 3.

Otherwise, this embodiment is of the same construction as Embodiment 1.

Next, operation is described. When the position detection signal, the speed detection signal, and the acceleration detection signal are input to the output portion 114 from the car position sensor 109, the car speed sensor 110, and the car acceleration sensor 111, respectively, the output portion 114 calculates the position, the speed, and the acceleration of the car 3 based on the respective detection signals thus input. After that, the output portion 114 compares the car speed abnormality determination criteria and the car acceleration abnormality determination criteria obtained from the memory portion 113 with the speed and the acceleration of the car 3 calculated based on the respective detection signals input. Through this comparison, the output portion 114 detects whether or not there is an abnormality in either the speed or the acceleration of the car 3.

During normal operation, the speed of the car 3 has approximately the same value as the normal speed detection pattern, and the acceleration of the car 3 has approximately the same value as the normal acceleration detection pattern. Thus, the output portion 114 detects that there is no abnormality in either the speed or the acceleration of the car 3, and normal operation of the elevator continues.

When, for example, the speed of the car 3 abnormally increases and exceeds the first abnormal speed detection pattern 116 due to some cause, the output portion 114 detects that there is an abnormality in the speed of the car 3. Then, the output portion 114 outputs an actuation signal and a stop signal to the hoisting machine braking device 106 and the control panel 102, respectively. As a result, the hoisting machine 101 is stopped, and the hoisting machine braking device 106 is operated to brake the rotation of the drive sheave 104.

When the acceleration of the car 3 abnormally increases and exceeds the first abnormal acceleration set value 119, the output portion 114 outputs an actuation signal and a stop signal to the hoisting machine braking device 106 and the control panel 102, respectively, thereby braking the rotation of the drive sheave 104.

If the speed of the car 3 continues to increase after the actuation of the hoisting machine braking device 106 and exceeds the second abnormal speed set value 117, the output portion 114 outputs an actuation signal to the safety device 33 while still outputting the actuation signal to the hoisting machine braking device 106. Thus, the safety device 33 is actuated and the car 3 is braked through the same operation as that of Embodiment 2.

Further, when the acceleration of the car 3 continues to increase after the actuation of the hoisting machine braking device 106, and exceeds the second abnormal acceleration set value 120, the output portion 114 outputs an actuation signal to the safety device 33 while still outputting the actuation signal to the hoisting machine braking device 106. Thus, the safety device 33 is actuated.

With the above-described elevator apparatus as well, by employing the same safety device 33 as that of Embodiment 1, the braking distance the car 3 travels until it comes to a stop can be shortened, and stable braking can be applied to the car 3.

Further, the monitor device 108 obtains the speed of the car 3 and the acceleration of the car 3 based on the information from the detection means 112 for detecting the state of the elevator. When the monitor device 108 judges that there is an abnormality in the obtained speed of the car 3 or the obtained acceleration of the car 3, the monitor device 108 outputs an actuation signal to at least one of the hoisting machine braking device 106 and the safety device 33. That is, judgment of the presence or absence of an abnormality is made by the monitor device 108 separately for a variety of abnormality determination factors such as the speed of the car and the acceleration of the car. Accordingly, an abnormality in the elevator can be detected earlier and more reliably. Therefore, it takes a shorter time for the braking force on the car 3 to be generated after occurrence of an abnormality in the elevator.

Further, the monitor device 108 includes the memory portion 113 that stores the car speed abnormality determination criteria used for judging whether or not there is an abnormality in the speed of the car 3, and the car acceleration abnormality determination criteria used for judging whether or not there is an abnormality in the acceleration of the car 3. Therefore, it is easy to change the judgment criteria used for judging whether or not there is an abnormality in the speed and the acceleration of the car 3, respectively, allowing easy adaptation to design changes or the like of the elevator.

Further, the following patterns are set for the car speed abnormality determination criteria: the normal speed detection pattern 115, the first abnormal speed detection pattern 116 having a larger value than the normal speed detection pattern 115, and the second abnormal speed detection pattern 117 having a larger value than the first abnormal speed detection pattern 116. When the speed of the car 3 exceeds the first abnormal speed detection pattern 116, the monitor device 108 outputs an actuation signal to the hoisting machine braking device 106, and when the speed of the car 3 exceeds the second abnormal speed detection pattern 117, the monitor device 108 outputs an actuation signal to the hoisting machine braking device 106 and the safety device 33. Therefore, the car 3 can be braked stepwise according to the degree of this abnormality in the speed of the car 3. As a result, the frequency of large shocks exerted on the car 3 can be reduced, and the car 3 can be more reliably stopped.

Further, the following patterns are set for the car acceleration abnormality determination criteria: the normal acceleration detection pattern 118, the first abnormal acceleration detection pattern 119 having a larger value than the normal acceleration detection pattern 118, and the second abnormal acceleration detection pattern 120 having a larger value than the first abnormal acceleration detection pattern 119. When the acceleration of the car 3 exceeds the first abnormal acceleration detection pattern 119, the monitor device 108 outputs an actuation signal to the hoisting machine braking device 106, and when the acceleration of the car 3 exceeds the second abnormal acceleration detection pattern 120, the monitor device 108 outputs an actuation signal to the hoisting machine braking device 106 and the safety device 33. Therefore, the car 3 can be braked stepwise according to the degree of an abnormality in the acceleration of the car 3. Normally, an abnormality occurs in the acceleration of the car 3 before an abnormality occurs in the speed of the car 3. As a result, the frequency of large shocks exerted on the car 3 can be reduced, and the car 3 can be more reliably stopped.

Further, the normal speed detection pattern 115, the first abnormal speed detection pattern 116, and the second abnormal speed detection pattern 117 are each set in association with the position of the car 3. Therefore, the first abnormal speed detection pattern 116 and the second abnormal speed detection pattern 117 each can be set in association with the normal speed detection pattern 115 at all locations in the ascending/descending section of the car 3. In the acceleration/deceleration sections, in particular, the first abnormal speed detection pattern 116 and the second abnormal speed detection pattern 117 each can be set to a relatively small value because the normal speed detection pattern 115 has a small value. As a result, the impact acting on the car 3 upon braking can be mitigated.

It should be noted that in the above-described example, the car speed sensor 110 is used when the monitor 108 obtains the speed of the car 3. However, instead of using the car speed sensor 110, the speed of the car 3 may be obtained from the position of the car 3 detected by the car position sensor 109. That is, the speed of the car 3 may be obtained by differentiating the position of the car 3 calculated by using the position detection signal from the car position sensor 109.

Further, in the above-described example, the car acceleration sensor 111 is used when the monitor 108 obtains the acceleration of the car 3. However, instead of using the car acceleration sensor 111, the acceleration of the car 3 may be obtained from the position of the car 3 detected by the car position sensor 109. That is, the acceleration of the car 3 maybe obtained by differentiating, twice, the position of the car 3 calculated by using the position detection signal from the car position sensor 109.

Further, in the above-described example, the output portion 114 determines to which braking means it should output the actuation signals according to the degree of the abnormality in the speed and acceleration of the car 3 constituting the abnormality determination factors. However, the braking means to which the actuation signals are to be output may be determined in advance for each abnormality determination factor.

Embodiment 4

Figure 20:
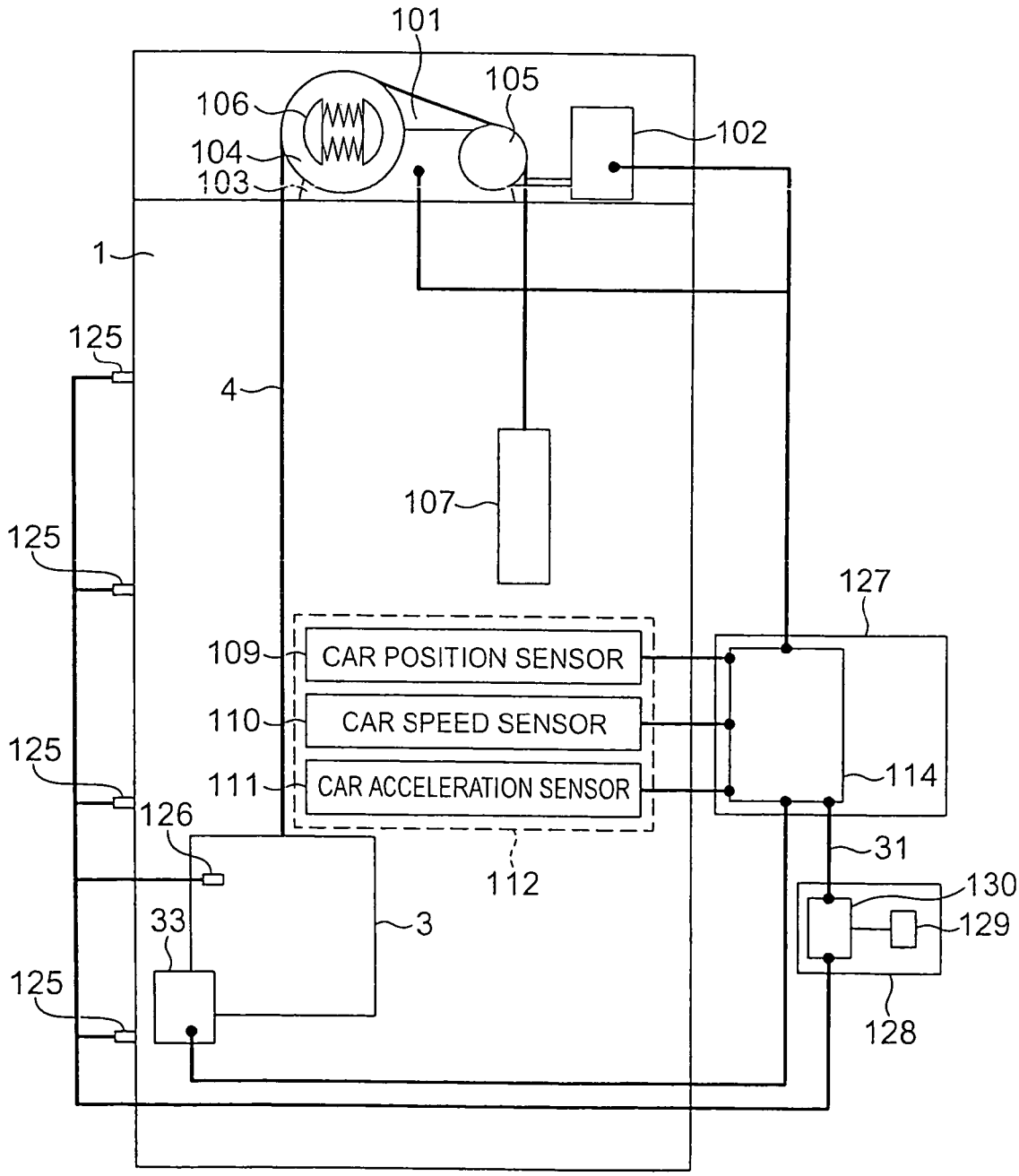
FIG. 20 is a schematic diagram showing an elevator apparatus according to Embodiment 4 of the present invention.

FIG. 20 is a schematic diagram showing an elevator apparatus according to Embodiment 4 of the present invention. In FIG. 20, a plurality of hall call buttons 125 are provided in the hall of each floor. A plurality of destination floor buttons 126 are provided in the car 3. A monitor device 127 has the output portion 114. An abnormality determination criteria generating device 128 for generating a car speed abnormality determination criteria and a car acceleration abnormality determination criteria is electrically connected to the output portion 114. The abnormality determination criteria generating device 128 is electrically connected to each hall call button 125 and each destination floor button 126. A position detection signal is input to the abnormality determination criteria generating device 128 from the car position sensor 109 via the output portion 114.

The abnormality determination criteria generating device 128 includes a memory portion 129 and a generation portion 130. The memory portion 129 stores a plurality of car speed abnormality determination criteria and a plurality of car acceleration abnormality determination criteria, which serve as abnormal judgment criteria for all the cases where the car 3 ascends and descends between the floors. The generation portion 130 selects a car speed abnormality determination criteria and a car acceleration abnormality determination criteria one by one from the memory portion 129, and outputs the car speed abnormality determination criteria and the car acceleration abnormality determination criteria to the output portion 114.

Each car speed abnormality determination criteria has three detection patterns each associated with the position of the car 3, which are similar to those of FIG. 18 of Embodiment 3. Further, each car acceleration abnormality determination criteria has three detection patterns each associated with the position of the car 3, which are similar to those of FIG. 19 of Embodiment 3.

The generation portion 130 calculates a detection position of the car 3 based on information from the car position sensor 109, and calculates a target floor of the car 3 based on information from at least one of the hall call buttons 125 and the destination floor buttons 126. The generation portion 130 selects one by one a car speed abnormality determination criteria and a car acceleration abnormality determination criteria used for a case where the calculated detection position and the target floor are one and the other of the terminal floors.

Otherwise, this embodiment is of the same construction as Embodiment 3.

Next, operation is described. A position detection signal is constantly input to the generation portion 130 from the car position sensor 109 via the output portion 114. When a passenger or the like selects any one of the hall call buttons 125 or the destination floor buttons 126 and a call signal is input to the generation portion 130 from the selected button, the generation portion 130 calculates a detection position and a target floor of the car 3 based on the input position detection signal and the input call signal, and selects one out of both a car speed abnormality determination criteria and a car acceleration abnormality determination criteria. After that, the generation portion 130 outputs the selected car speed abnormality determination criteria and the selected car acceleration abnormality determination criteria to the output portion 114.

The output portion 114 detects whether or not there is an abnormality in the speed and the acceleration of the car 3 in the same way as in Embodiment 3. Thereafter, this embodiment is of the same operation as Embodiment 1.

With the above-described elevator apparatus as well, by employing the same safety device 33 as that of Embodiment 1, the braking distance the car 3 travels until it comes to a stop can be shortened, and stable braking can be applied to the car 3.

Further, the car speed abnormality determination criteria and the car acceleration abnormality determination criteria are generated based on the information from at least one of the hall call buttons 125 and the destination floor buttons 126. Therefore, it is possible to generate the car speed abnormality determination criteria and the car acceleration abnormality determination criteria corresponding to the target floor. As a result, the time it takes for the braking force on the car 3 to be generated after occurrence of an abnormality in the elevator can be reduced even when a different target floor is selected.

It should be noted that in the above-described example, the generation portion 130 selects one out of both the car speed abnormality determination criteria and car acceleration abnormality determination criteria from among a plurality of car speed abnormality determination criteria and a plurality of car acceleration abnormality determination criteria stored in the memory portion 129. However, the generation portion may directly generate an abnormal speed detection pattern and an abnormal acceleration detection pattern based on the normal speed pattern and the normal acceleration pattern of the car 3 generated by the control panel 102.

Embodiment 5

Figure 21:
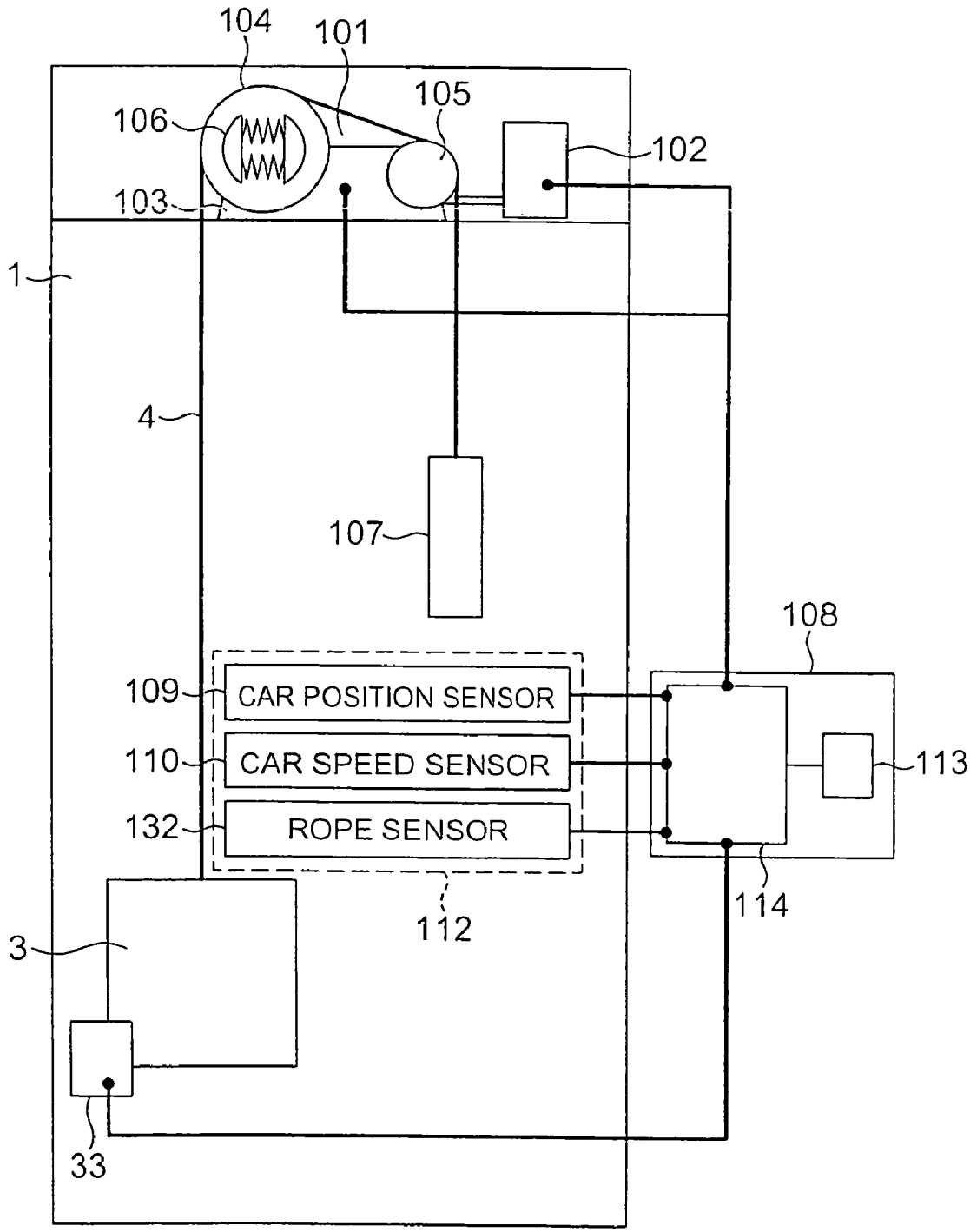
FIG. 21 is a schematic diagram showing an elevator apparatus according to Embodiment 5 of the present invention.
Figure 23:
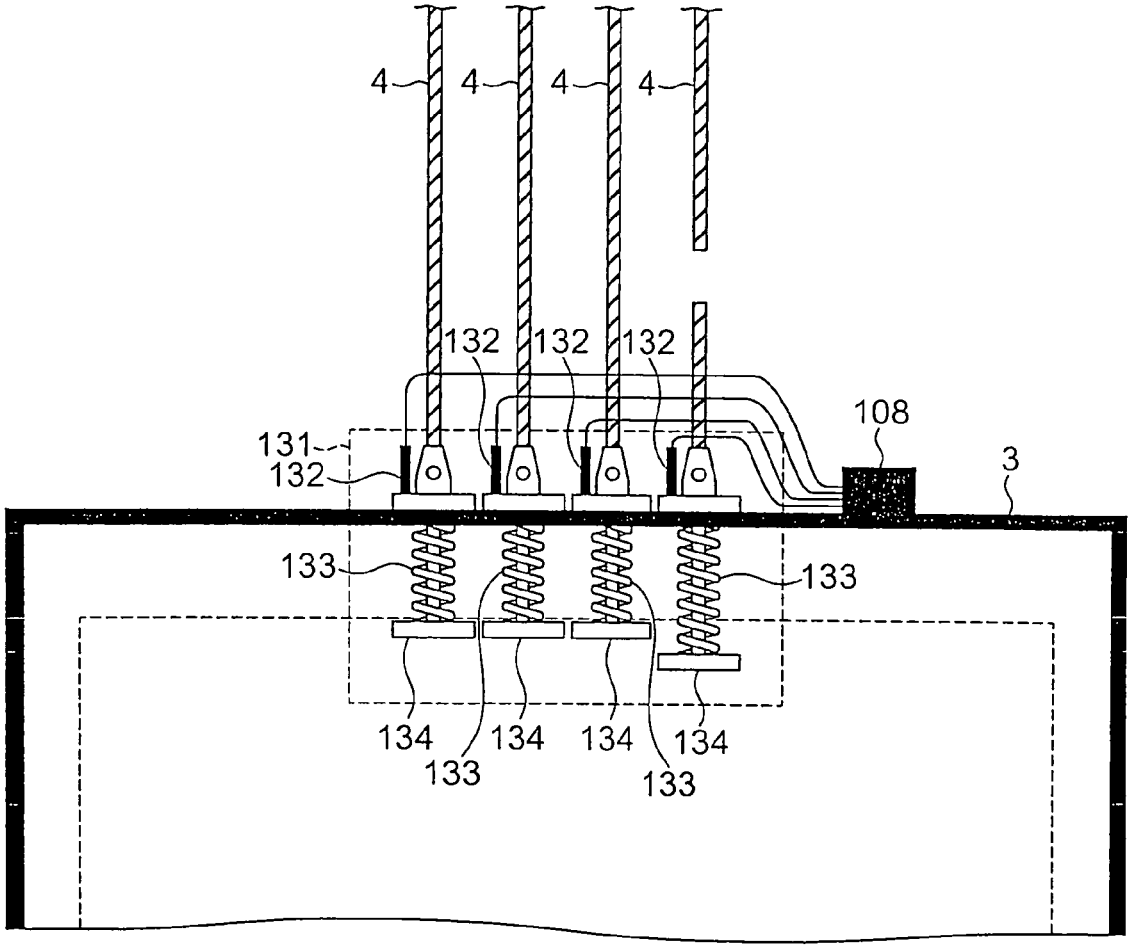
FIG. 23 is a diagram showing a state where one of the main ropes of FIG. 22 has broken.

FIG. 21 is a schematic diagram showing an elevator apparatus according to Embodiment 5 of the present invention. In this example, each of the main ropes 4 is connected to an upper portion of the car 3 via a rope fastening device 131 (FIG. 23). The monitor device 108 is mounted on an upper portion of the car 3. The car position sensor 109, the car speed sensor 110, and a plurality of rope sensors 132 are electrically connected to the output portion 114. Rope sensors 132 are provided in the rope fastening device 131, and each serve as a rope break detecting portion for detecting whether or not a break has occurred in each of the ropes 4. The detection means 112 includes the car position sensor 109, the car speed sensor 110, and the rope sensors 132.

The rope sensors 132 each output a rope brake detection signal to the output portion 114 when the main ropes 4 break. The memory portion 113 stores the car speed abnormality determination criteria similar to that of Embodiment 3 shown in FIG. 18, and a rope abnormality determination criteria used as a reference for judging whether or not there is an abnormality in the main ropes 4.

A first abnormal level indicating a state where at least one of the main ropes 4 have broken, and a second abnormal level indicating a state where all of the main ropes 4 has broken are set for the rope abnormality determination criteria.

The output portion 114 calculates the position of the car 3 based on the input position detection signal. The output portion 114 also calculates the speed of the car 3 and the state of the main ropes 4 based on the input speed detection signal and the input rope brake signal, respectively, as a variety of (in this example, two) abnormality determination factors.

The output portion 114 outputs an actuation signal (trigger signal) to the hoisting machine braking device 106 when the speed of the car 3 exceeds the first abnormal speed detection pattern 116 (FIG. 18), or when at least one of the main ropes 4 breaks. When the speed of the car 3 exceeds the second abnormal speed detection pattern 117 (FIG. 18), or when all of the main ropes 4 break, the output portion 114 outputs an actuation signal to the hoisting machine braking device 106 and the safety device 33. That is, the output portion 114 determines to which braking means it should output the actuation signals according to the degree of an abnormality in the speed of the car 3 and the state of the main ropes 4.

Figure 22:
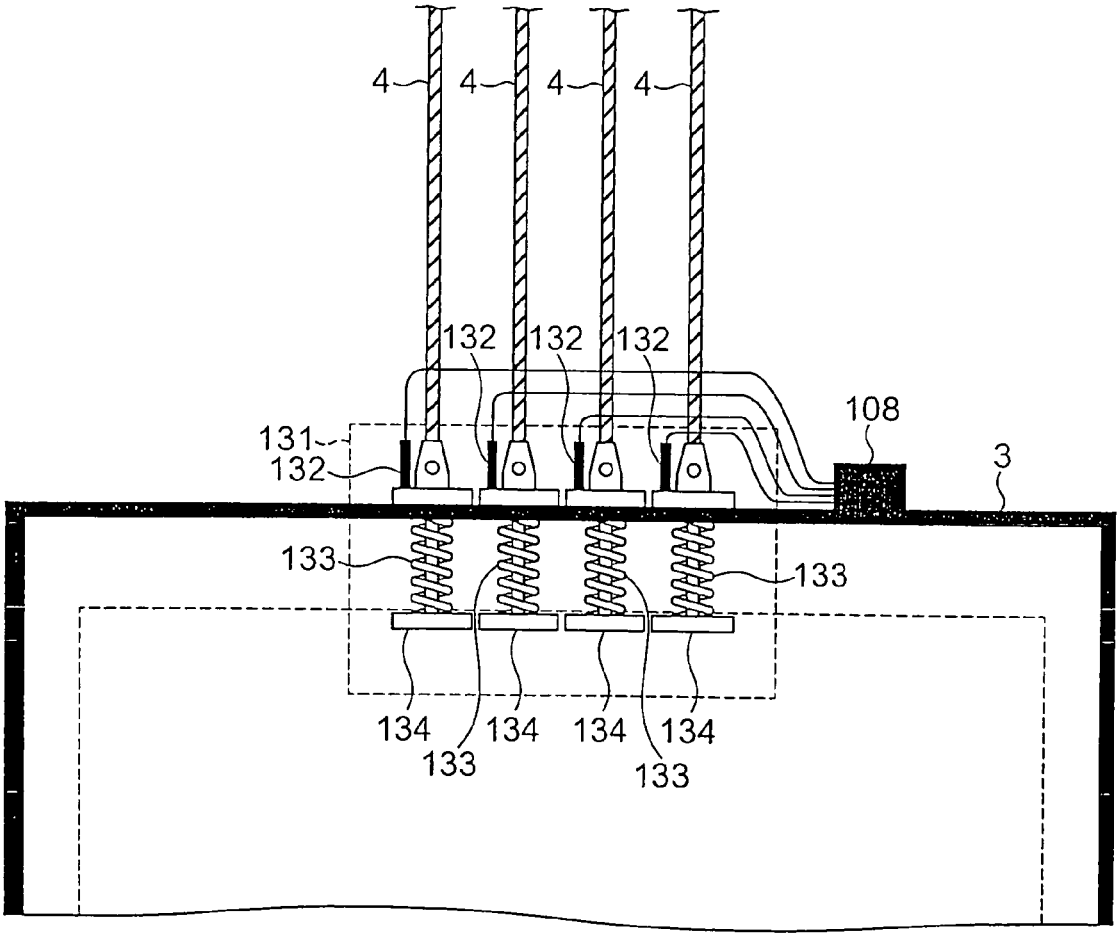
FIG. 22 is a diagram showing the rope fastening device and the rope sensors of FIG. 21.

FIG. 22 is a diagram showing the rope fastening device 131 and the rope sensors 132 of FIG. 21. FIG. 23 is a diagram showing a state where one of the main ropes 4 of FIG. 22 has broken. In FIGS. 22 and 23, the rope fastening device 131 includes a plurality of rope connection portions 134 for connecting the main ropes 4 to the car 3. The rope connection portions 134 each include an spring 133 provided between the main rope 4 and the car 3. The position of the car 3 is displaceable with respect to the main ropes 4 by the expansion and contraction of the springs 133.

The rope sensors 132 are each provided to the rope connection portion 134. The rope sensors 132 each serve as a displacement measuring device for measuring the amount of expansion of the spring 133. Each rope sensor 132 constantly outputs a measurement signal corresponding to the amount of expansion of the spring 133 to the output portion 114. A measurement signal obtained when the expansion of the spring 133 returning to its original state has reached a predetermined amount is input to the output portion 114 as a break detection signal. It should be noted that each of the rope connection portions 134 maybe provided with a scale device that directly measures the tension of the main ropes 4.

Otherwise, this embodiment is of the same construction as Embodiment 3.

Next, operation is described. When the position detection signal, the speed detection signal, and the break detection signal are input to the output portion 114 from the car position sensor 109, the car speed sensor 110, and each rope sensor 131, respectively, the output portion 114 calculates the position of the car 3, the speed of the car 3, and the number of main ropes 4 that have broken based on the respective detection signals thus input. After that, the output portion 114 compares the car speed abnormality determination criteria and the rope abnormality determination criteria obtained from the memory portion 113 with the speed of the car 3 and the number of broken main ropes 4 calculated based on the respective detection signals input. Though this comparison, the output portion 114 detects whether or not there is an abnormality in both the speed of the car 3 and the state of the main ropes 4.

During normal operation, the speed of the car 3 has approximately the same value as the normal speed detection pattern, and the number of broken main ropes 4 is zero. Thus, the output portion 114 detects that there is no abnormality in either the speed of the car 3 or the state of the main ropes 4, and normal operation of the elevator continues.

When, for example, the speed of the car 3 abnormally increases and exceeds the first abnormal speed detection pattern 116 (FIG. 18) for some reason, the output portion 114 detects that there is an abnormality in the speed of the car 3. Then, the output portion 114 outputs an actuation signal and a stop signal to the hoisting machine braking device 106 and the control panel 102, respectively. As a result, the hoisting machine 101 is stopped, and the hoisting machine raking device 106 is operated to brake the rotation of the drive sheave 104.

Further, when at least one of the main ropes 4 has broken, the output portion 114 outputs an actuation signal and a stop signal to the hoisting machine braking device 106 and the control panel 102, respectively, thereby braking the rotation of the drive sheave 104.

If the speed of the car 3 continues to increase after the actuation of the hoisting machine braking device 106 and exceeds the second abnormal speed set value 117 (FIG. 18), the output portion 114 outputs an actuation signal to the safety device 33 while still outputting the actuation signal to the hoisting machine braking device 106. Thus, the safety device 33 is actuated and the car 3 is braked through the same operation as that of Embodiment 2.

Further, if all the main ropes 4 break after the actuation of the hoisting machine braking device 106, the output portion 114 outputs an actuation signal to the safety device 33 while still outputting the actuation signal to the hoisting machine braking device 106. Thus, the safety device 33 is actuated.

With the above-described elevator apparatus as well, by employing the same safety device 33 as that of Embodiment 1, the braking distance the car 3 travels until it comes to a stop can be shortened, and stable braking can be applied to the car 3.

Further, the monitor device 108 obtains the speed of the car 3 and the state of the main ropes 4 based on the information from the detection means 112 for detecting the state of the elevator. When the monitor device 108 judges that there is an abnormality in the obtained speed of the car 3 or the obtained state of the main ropes 4, the monitor device 108 outputs an actuation signal to at least one of the hoisting machine braking device 106 and the safety device 33. This means that the number of targets for abnormality detection increases, allowing abnormality detection of not only the speed of the car 3 but also the state of the main ropes 4. Accordingly, an abnormality in the elevator can be detected earlier and more reliably. Therefore, it takes a shorter time for the braking force on the car 3 to be generated after occurrence of an abnormality in the elevator.

It should be noted that in the above-described example, the rope sensor 132 is disposed in the rope fastening device 131 provided to the car 3. However, the rope sensor 132 may be disposed in a rope fastening device provided to the counterweight 107.

Further, in the above-described example, the present invention is applied to an elevator apparatus of the type in which the car 3 and the counterweight 107 are suspended in the hoistway 1 by connecting one end portion and the other end portion of the main rope 4 to the car 3 and the counterweight 107, respectively. However, the present invention may also be applied to an elevator apparatus of the type in which the car 3 and the counterweight 107 are suspended in the hoistway 1 by wrapping the main rope 4 around a car suspension sheave and a counterweight suspension sheave, with one end portion and the other end portion of the main rope 4 connected to structures arranged in the hoistway 1. In this case, the rope sensor is disposed in the rope fastening device provided to the structures arranged in the hoistway 1.

Embodiment 6

Figure 24:
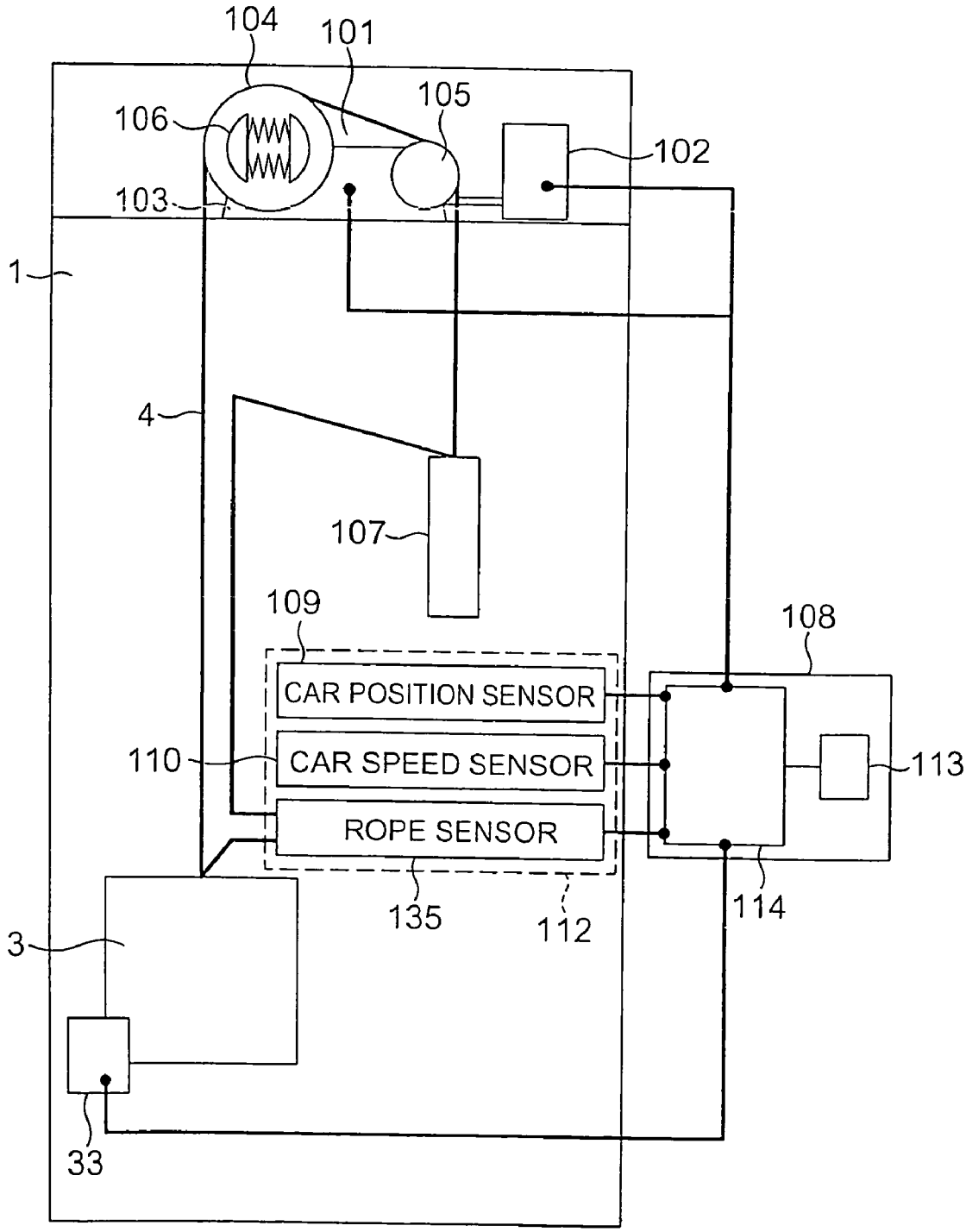
FIG. 24 is a schematic diagram showing an elevator apparatus according to Embodiment 6 of the present invention.

FIG. 24 is a schematic diagram showing an elevator apparatus according to Embodiment 6 of the present invention. In this example, a rope sensor 135 serving as a rope brake detecting portion is constituted by lead wires embedded in each of the main ropes 4. Each of the lead wires extends in the longitudinal direction of the rope 4. Both end portion of each lead wire are electrically connected to the output portion 114. A weak current flows in the lead wires. Cut-off of current flowing in each of the lead wires is input as a rope brake detection signal to the output portion 114.

Otherwise, this embodiment is of the same construction as Embodiment 5.

With the above-described elevator apparatus as well, by employing the same safety device 33 as that of Embodiment 1, the braking distance the car 3 travels until it comes to a stop can be shortened, and stable braking can be applied to the car 3.

Further, a break in any main rope 4 is detected based on cutting off of current supply to any lead wire embedded in the main ropes 4. Accordingly, whether or not the rope has broken is more reliably detected without being affected by a change of tension of the main ropes 4 due to acceleration and deceleration of the car 3.

Embodiment 7

Figure 25:
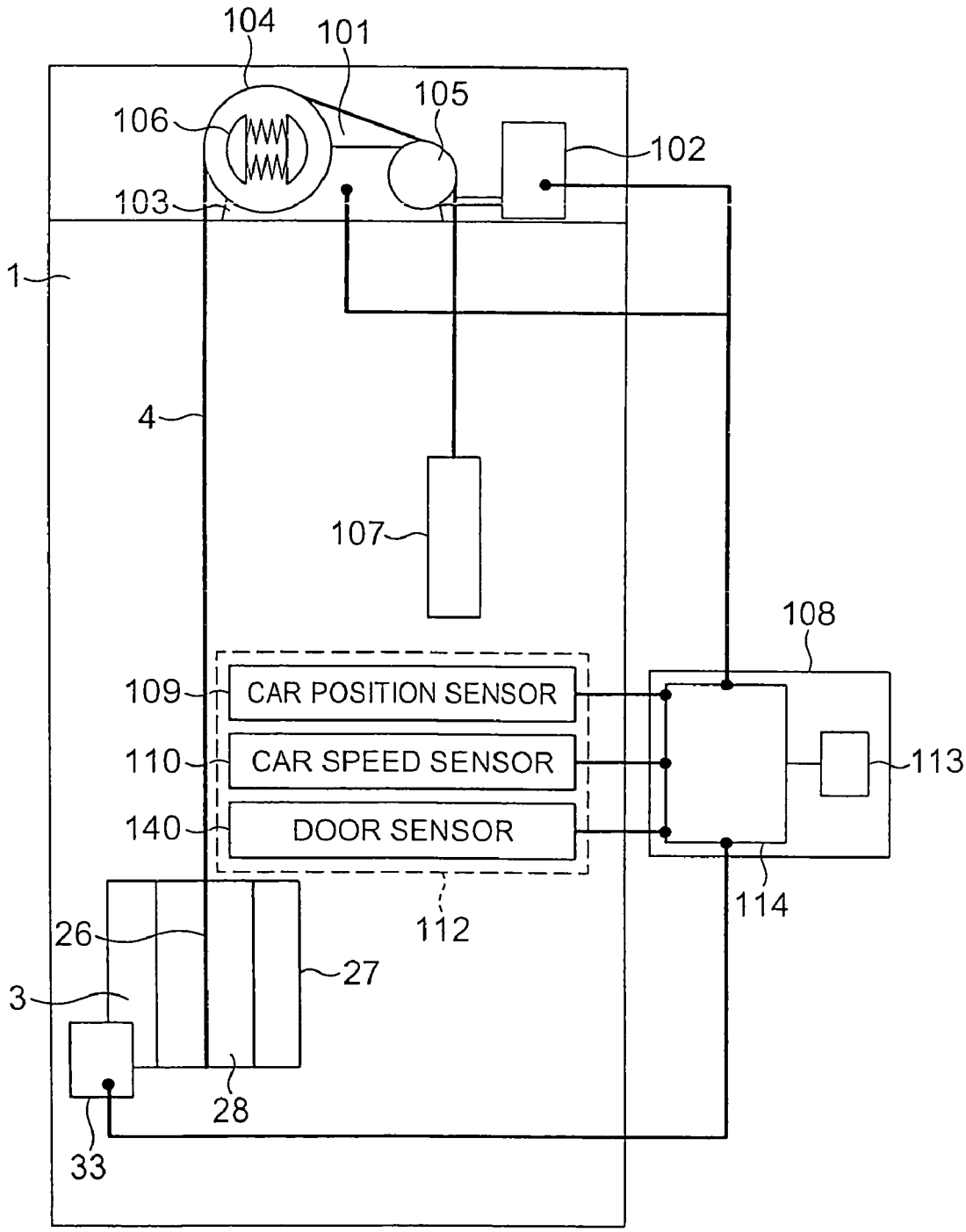
FIG. 25 is a schematic diagram showing an elevator apparatus according to Embodiment 7 of the present invention.

FIG. 25 is a schematic diagram showing an elevator apparatus according to Embodiment 7 of the present invention. In FIG. 25, the car position sensor 109, the car speed sensor 110, and a door sensor 140 are electrically connected to the output portion 114. The door sensor 140 serves as an entrance open/closed detecting portion for detecting open/closed of the car entrance 26. The detection means 112 includes the car position sensor 109, the car speed sensor 110, and the door sensor 140.

The door sensor 140 outputs a door-closed detection signal to the output portion 114 when the car entrance 26 is closed. The memory portion 113 stores the car speed abnormality determination criteria similar to that of Embodiment 3 shown in FIG. 18, and an entrance abnormality determination criteria used as a reference for judging whether or not there is an abnormality in the open/close state of the car entrance 26. If the car ascends/descends while the car entrance 26 is not closed, the entrance abnormality determination criteria regards this as an abnormal state.

The output portion 114 calculates the position of the car 3 based on the input position detection signal. The output portion 114 also calculates the speed of the car 3 and the state of the car entrance 26 based on the input speed detection signal and the input door-closing detection signal, respectively, as a variety of (in this example, two) abnormality determination factors.

The output portion 114 outputs an actuation signal to the hoisting machine braking device 104 if the car ascends/descends while the car entrance 26 is not closed, or if the speed of the car 3 exceeds the first abnormal speed detection pattern 116 (FIG. 18). If the speed of the car 3 exceeds the second abnormal speed detection pattern 117 (FIG. 18), the output portion 114 outputs an actuation signal to the hoisting machine braking device 106 and the safety device 33.

Figure 26:
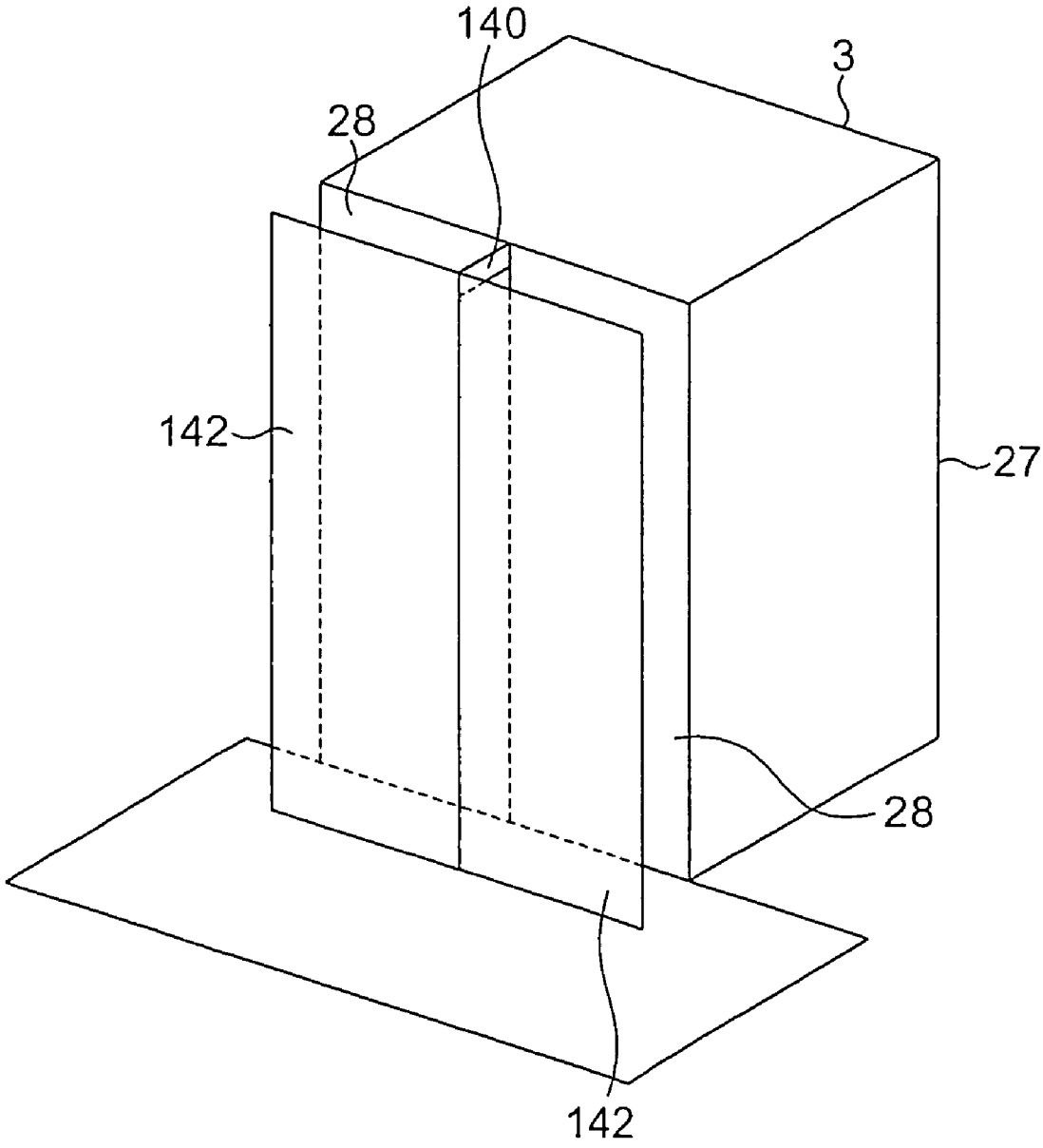
FIG. 26 is a perspective view of the car and the door sensor of FIG. 25.
Figure 27:
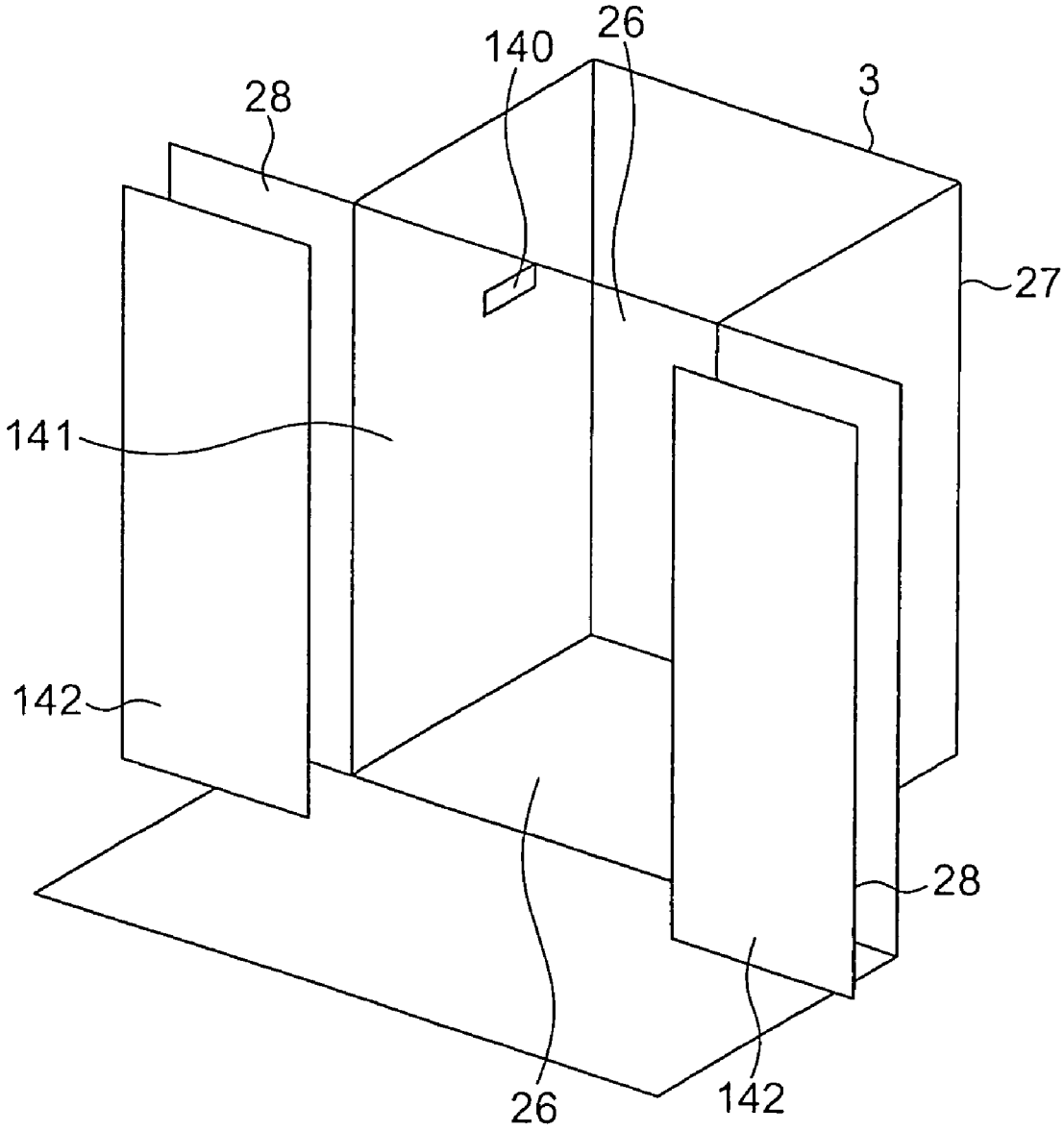
FIG. 27 is a perspective view showing a state in which the car entrance of FIG. 26 is open.

FIG. 26 is a perspective view of the car 3 and the door sensor 140 of FIG. 25. FIG. 27 is a perspective view showing a state in which the car entrance 26 of FIG. 26 is open. In FIGS. 26 and 27, the door sensor 140 is provided at an upper portion of the car entrance 26 and in the center of the car entrance 26 with respect to the width direction of the car 3. The door sensor 140 detects displacement of each of the car doors 28 into the door-closed position, and outputs the door-closed detection signal to the output portion 114.

It should be noted that a contact type sensor, a proximity sensor, or the like may be used for the door sensor 140. The contact type sensor detects closing of the doors through its contact with a fixed portion secured to each of the car doors 28. The proximity sensor detects closing of the doors without contacting the car doors 28. Further, a pair of hall doors 142 for opening/closing a hall entrance 141 are provided at the hall entrance 141. The hall doors 142 are engaged to the car doors 28 by means of an engagement device (not shown) when the car 3 rests at a hall floor, and are displaced together with the car doors 28.

Otherwise, this embodiment is of the same construction as Embodiment 3.

Next, operation is described. When the position detection signal, the speed detection signal, and the door-closed detection signal are input to the output portion 114 from the car position sensor 109, the car speed sensor 110, and the door sensor 140, respectively, the output portion 114 calculates the position of the car 3, the speed of the car 3, and the state of the car entrance 26 based on the respective detection signals thus input. After that, the output portion 114 compares the car speed abnormality determination criteria and the drive device state abnormality determination criteria obtained from the memory portion 113 with the speed of the car 3 and the state of the car of the car doors 28 calculated based on the respective detection signals input. Through this comparison, the output portion 114 detects whether or not there is an abnormality in each of the speed of the car 3 and the state of the car entrance 26.

During normal operation, the speed of the car 3 has approximately the same value as the normal speed detection pattern, and the car entrance 26 is closed while the car 3 ascends/descends. Thus, the output portion 114 detects that there is no abnormality in each of the speed of the car 3 and the state of the car entrance 26, and normal operation of the elevator continues.

When, for instance, the speed of the car 3 abnormally increases and exceeds the first abnormal speed detection pattern 116 (FIG. 18) for some reason, the output portion 114 detects that there is an abnormality in the speed of the car 3. Then, the output portion 114 outputs an actuation signal and a stop signal to the hoisting machine braking device 106 and the control panel 102, respectively. As a result, the hoisting machine 101 is stopped, and the hoisting machine braking device 106 is actuated to brake the rotation of the drive sheave 104.

Further, the output portion 114 also detects an abnormality in the car entrance 26 when the car 3 ascends/descends while the car entrance 26 is not closed. Then, the output portion 114 outputs an actuation signal and a stop signal to the hoisting machine braking device 106 and the control panel 102, respectively, thereby braking the rotation of the drive sheave 104.

When the speed of the car 3 continues to increase after the actuation of the hoisting machine braking device 106, and exceeds the second abnormal speed set value 117 (FIG. 18), the output portion 114 outputs an actuation signal to the safety device 33 while still outputting the actuation signal to the hoisting machine braking device 106. Thus, the safety device 33 is actuated and the car 3 is braked through the same operation as that of Embodiment 1.

With the above-described elevator apparatus as well, by employing the same safety device 33 as that of Embodiment 1, the braking distance the car 3 travels until it comes to a stop can be shortened, and stable braking can be applied to the car 3.

Further, the monitor device 108 obtains the speed of the car 3 and the state of the car entrance 26 based on the information from the detection means 112 for detecting the state of the elevator. When the monitor device 108 judges that there is an abnormality in the obtained speed of the car 3 or the obtained state of the car entrance 26, the monitor device 108 outputs an actuation signal to at least one of the hoisting machine braking device 106 and the safety device 33. This means that the number of targets for abnormality detection increases, allowing abnormality detection of not only the speed of the car 3 but also the state of the car entrance 26. Accordingly, abnormalities of the elevator can be detected earlier and more reliably. Therefore, it takes less time for the braking force on the car 3 to be generated after occurrence of an abnormality in the elevator.

It should be noted that while in the above-described example, the door sensor 140 only detects the state of the car entrance 26, the door sensor 140 may detect both the state of the car entrance 26 and the state of the elevator hall entrance 141. In this case, the door sensor 140 detects displacement of the elevator hall doors 142 into the door-closed position, as well as displacement of the car doors 28 into the door-closed position. With this construction, abnormality in the elevator can be detected even when only the car doors 28 are displaced due to a problem with the engagement device or the like that engages the car doors 28 and the elevator hall doors 142 with each other.

Embodiment 8

Figure 28:
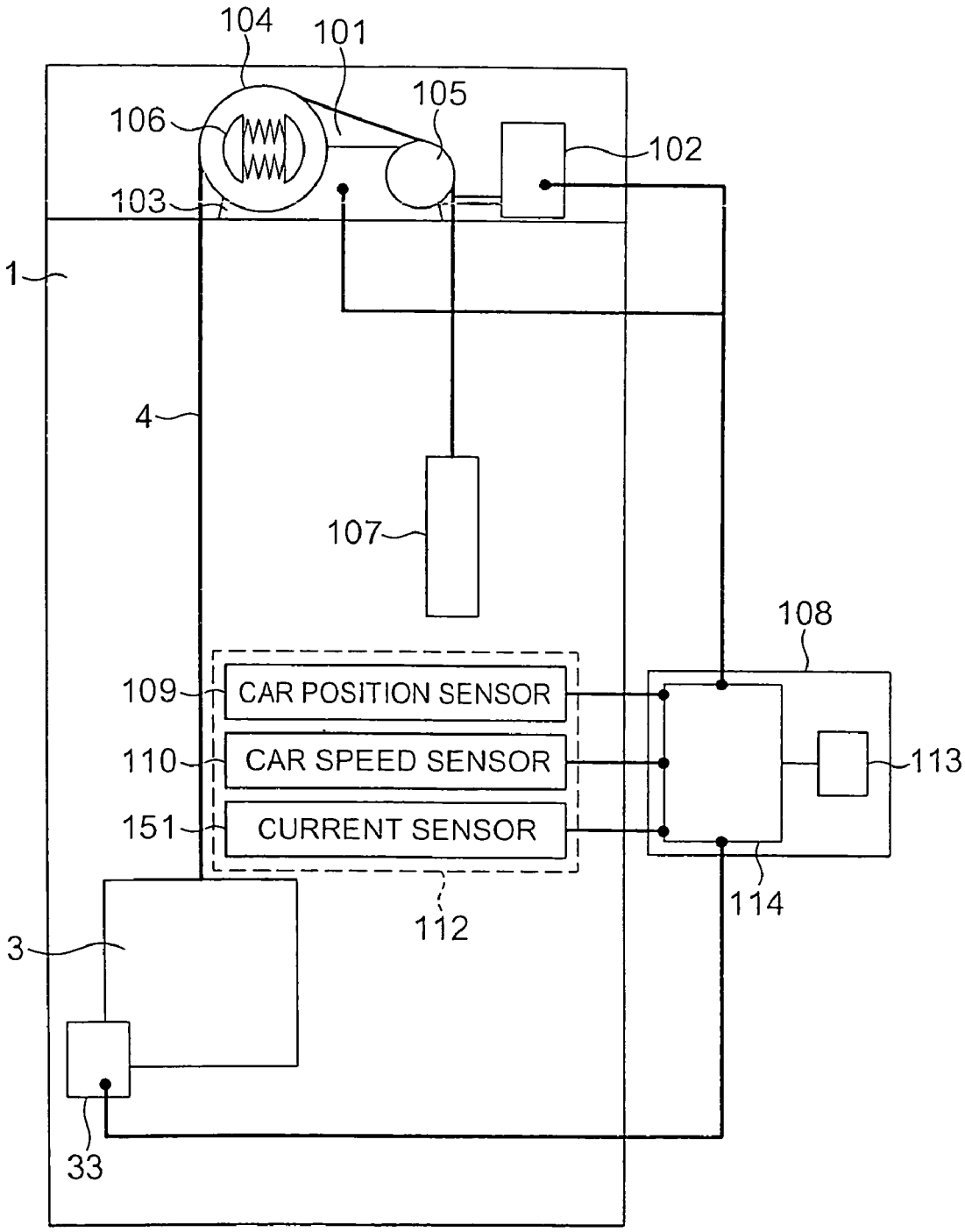
FIG. 28 is a schematic diagram showing an elevator apparatus according to Embodiment 8 of the present invention.
Figure 29:
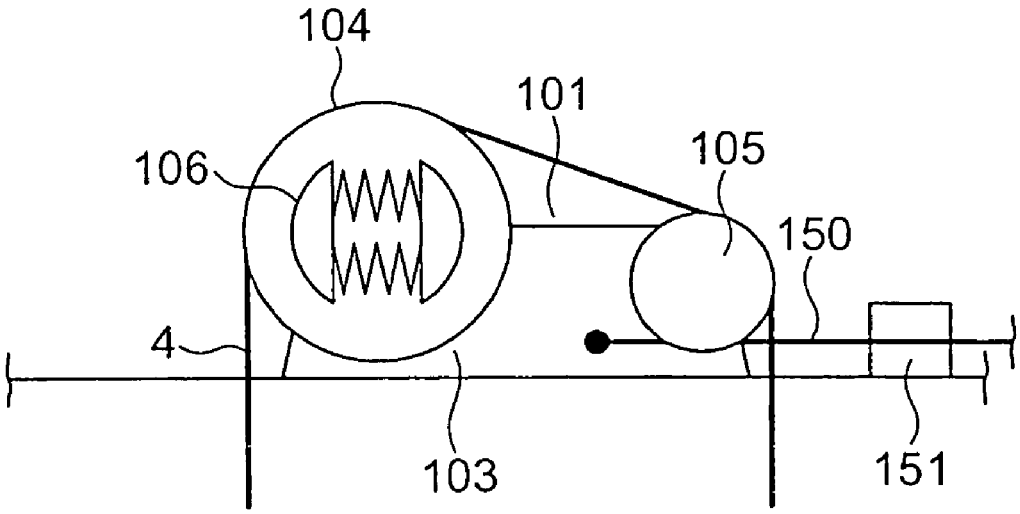
FIG. 29 is a diagram showing an upper portion of the hoistway of FIG. 28.

FIG. 28 is a schematic diagram showing an elevator apparatus according to Embodiment 8 of the present invention. FIG. 29 is a diagram showing an upper portion of the hoistway 1 of FIG. 28. In FIGS. 28 and 29, a power supply cable 150 is electrically connected to the hoisting machine 110. Drive power is supplied to the hoisting machine 101 via the power supply cable 150 through control of the control panel 102.

A current sensor 151 serving as a drive device detection portion is provided to the power supply cable 150. The current sensor 151 detects the state of the hoisting machine 101 by measuring the current flowing in the power supply cable 150. The current sensor 151 outputs to the output portion 114 a current detection signal (drive device state detection signal) corresponding to the value of a current in the power supply cable 150. The current sensor 151 is provided in the upper portion of the hoistway 1. A current transformer (CT) that measures an induction current generated in accordance with the amount of current flowing in the power supply cable 150 is used as the current sensor 151, for example.

The car position sensor 109, the car speed sensor 110, and the current sensor 151 are electrically connected to the output portion 114. The detection means 112 includes the car position sensor 109, the car speed sensor 110, and the current sensor 151.

The memory portion 113 stores the car speed abnormality determination criteria similar to that of Embodiment 3 shown in FIG. 18, and a drive device abnormality determination criteria used as a reference for determining whether or not there is an abnormality in the state of the hoisting machine 101.

The drive device abnormality determination criteria has three detection patterns. That is, a normal level that is the current value flowing in the power supply cable 150 during normal operation, a first abnormal level having a larger value than the normal level, and a second abnormal level having a larger value than the first abnormal level, are set for the drive device abnormality determination criteria.

The output portion 114 calculates the position of the car 3 based on the input position detection signal. The output portion 114 also calculates the speed of the car 3 and the state of the hoisting device 101 based on the input speed detection signal and the input current detection signal, respectively, as a variety of (in this example, two) abnormality determination factors.

The output portion 114 outputs an actuation signal (trigger signal) to the hoisting machine braking device 106 when the speed of the car 3 exceeds the first abnormal speed detection pattern 116 (FIG. 18), or when the amount of the current flowing in the power supply cable 150 exceeds the value of the first abnormal level of the drive device abnormality determination criteria. When the speed of the car 3 exceeds the second abnormal speed detection pattern 117 (FIG. 18), or when the amount of the current flowing in the power supply cable 150 exceeds the value of the second abnormal level of the drive device abnormality determination criteria, the output portion 114 outputs an actuation signal to the hoisting machine braking device 106 and the safety device 33. That is, the output portion 114 determines to which braking means it should output the actuation signals according to the degree of abnormality in each of the speed of the car 3 and the state of the hoisting machine 101.

Otherwise, this embodiment is of the same construction as embodiment 3.

Next, operation is described. When the position detection signal, the speed detection signal, and the current detection signal are input to the output portion 114 from the car position sensor 109, the car speed sensor 110, and the current sensor 151, respectively, the output portion 114 calculates the position of the car 3, the speed of the car 3, and the amount of current flowing in the power supply cable 151 based on the respective detection signals thus input. After that, the output portion 114 compares the car speed abnormality determination criteria and the drive device state abnormality determination criteria obtained from the memory portion 113 with the speed of the car 3 and the amount of the current flowing into the current supply cable 150 calculated based on the respective detection signals input. Through this comparison, the output portion 114 detects whether or not there is an abnormality in each of the speed of the car 3 and the state of the hoisting machine 101.

During normal operation, the speed of the car 3 has approximately the same value as the normal speed detection pattern 115 (FIG. 18), and the amount of current flowing in the power supply cable 150 is at the normal level. Thus, the output portion 114 detects that there is no abnormality in each of the speed of the car 3 and the state of the hoisting machine 101, and normal operation of the elevator continues.

If, for instance, the speed of the car 3 abnormally increases and exceeds the first abnormal speed detection pattern 116 (FIG. 18) for some reason, the output portion 114 detects that there is an abnormality in the speed of the car 3. Then, the output portion 114 outputs an actuation signal and a stop signal to the hoisting machine braking device 106 and the control panel 102, respectively. As a result, the hoisting machine 101 is stopped, and the hoisting machine braking device 106 is actuated to brake the rotation of the drive sheave 104.

If the amount of current flowing in the power supply cable 150 exceeds the first abnormal level in the drive device state abnormality determination criteria, the output portion 114 outputs an actuation signal and a stop signal to the hoisting machine braking device 106 and the control panel 102, respectively, thereby braking the rotation of the drive sheave 104.

When the speed of the car 3 continues to increase after the actuation of the hoisting machine braking device 106, and exceeds the second abnormal speed set value 117 (FIG. 18), the output portion 114 outputs an actuation signal to the safety device 33 while still outputting the actuation signal to the hoisting machine braking device 106. Thus, the safety device 33 is actuated and the car 3 is braked through the same operation as that of Embodiment 1.

When the amount of current flowing in the power supply cable 150 exceeds the second abnormal level of the drive device state abnormality determination criteria after the actuation of the hoisting machine braking device 106, the output portion 114 outputs an actuation signal to the safety device 33 while still outputting the actuation signal to the hoisting machine braking device 106. Thus, the safety device 33 is actuated.

With the above-described elevator apparatus as well, by employing the same safety device 33 as that of Embodiment 1, the braking distance the car 3 travels until it comes to a stop can be shortened, and stable braking can be applied to the car 3.

Further, the monitor device 108 obtains the speed of the car 3 and the state of the hoisting machine 101 based on the information from the detection means 112 for detecting the state of the elevator. When the monitor device 108 judges that there is an abnormality in the obtained speed of the car 3 or the state of the hoisting machine 101, the monitor device 108 outputs an actuation signal to at least one of the hoisting machine braking device 106 and the safety device 33. This means that the number of targets for abnormality detection increases, and it takes a shorter time for the braking force on the car 3 to be generated after occurrence of an abnormality in the elevator.

It should be noted that in the above-described example, the state of the hoisting machine 101 is detected using the current sensor 151 for measuring the amount of the current flowing in the power supply cable 150. However the state of the hoisting machine 101 may be detected using a temperature sensor for measuring the temperature of the hoisting machine 101.

Further, in Embodiments 1 through 8 described above, the electric cable is used as the transmitting means for supplying power from the output portion to the safety device. However, a wireless communication device having a transmitter provided at the output portion and a receiver provided at the safety device may be used instead. Alternatively, an optical fiber cable that transmits an optical signal may be used.

Further, in Embodiments 1 through 8, the safety device applies braking with respect to overspeed (motion) of the car in the downward direction. However, the safety device may apply braking with respect to overspeed (motion) of the car in the upward direction by using the safety device fixed upside down to the car.

The invention claimed is:

1. A safety device for an elevator, comprising:

a pair of pivot levers provided to a car guided by a guide rail, the pair of pivot levers being pivotable about a pair of pivot shafts that are parallel to each other;

a plurality of braking members each provided to each of the pivot levers, the plurality of braking members being capable of coming into and out of contact with the guide rail through pivotal movement of the pivot levers;

a connecting member pivotally connected to connecting portions of the pivot levers, the connecting portions located on opposite ends of the connecting member along a plane formed by a longitudinal axis of the connecting member; and an electromagnetic actuator configured to push the connecting member in a first direction to pivot the pivot levers in a braking direction to bring the braking members into contact with the guide rail and to pull the connecting member in a second direction to pivot the pivot levers in a releasing direction to bring the braking members out of contact with the guide rail, wherein the connecting portions of the connecting member with the pivot levers are arranged on the same side with respect to a plane containing axes of the pivot shafts, and wherein the electromagnetic actuator causes the connecting member to undergo reciprocating displacement in a direction perpendicular to the plane.

2. A safety device according to claim 1, wherein the actuator is connected to the safety device at a center position between the braking members.

3. A safety device according to claim 2, wherein the actuator is arranged above the connecting member.

4. A safety device according to claim 2, wherein the actuator is arranged below the connecting member.

5. A safety device according to claim 1, wherein the actuator includes a movable shaft extending between the actuator and the connecting member, the movable shaft is connected to the connecting member at a position of the connecting member equally between the connecting portions of the pivot levers.

6. A safety device according to claim 1, wherein the connecting member includes elongated holes at opposite end portions that are configured to pivotally connect with the connecting portions of the pivot levers.

7. A safety device according to claim 6, wherein the connecting portion for each pivot lever includes a projection that projects substantially perpendicular to a plane formed by the pivot lever, the projections slidably engage respective elongated holes of the connecting member.

8. A safety device according to claim 7, wherein the elongated holes extend in a longitudinal direction of the connecting member.

9. A safety device according to claim 1, wherein each of the braking members includes an engaging element to connect with an end portion of a respective pivot lever, the end portion of the pivot levers includes an elongated hole to receive the engaging element of the brake member.

10. A safety device according to claim 1, wherein the actuator pushes and pulls the connecting member in the first and second direction such that the connecting member is displaced substantially perpendicular to a plane that extends through longitudinal axes of the pivot shafts of the pivot levers.

11. A safety device for an elevator comprising:

a pair of pivot levers provided to a car guided by a guide rail, the pair of pivot levers being pivotable about a pair of pivot shafts that are parallel to each other;

a plurality of braking members each provided to each of the pivot levers, the plurality of braking members being capable of coming into and out of contact with the guide rail through pivotal movement of the pivot levers;

a connecting member pivotally connected to connecting portions of the pivot levers, the connecting portions located on opposite ends of the connecting member along a plane formed by a longitudinal axis of the connecting member; and an electromagnetic actuator configured to move the connecting member in a first direction to pivot the pivot levers in a braking direction to bring the braking members into contact with the guide rail and to move the connecting member in a second direction to pivot the pivot levers in a releasing direction to bring the braking members out of contact with the guide rail, wherein the connecting portions of the connecting member with the pivot levers are arranged on different sides with respect to a plane containing axes of the pivot shafts; and wherein the connecting member extends in opposite directions from the electromagnetic actuator and the electromagnetic actuator causes the connecting member to undergo reciprocating displacement along a straight line connecting between the connecting portions.

12. A safety device for an elevator according to claim 11, wherein the actuator is located along the plane extending between the axes of the pivot shafts, and wherein the connecting member extends substantially a same distance in opposite directions from the electromagnetic actuator.

13. A safety device for an elevator, comprising:

a pair of pivot levers provided to a car guided by a guide rail, the pair of pivot levers being pivotable about a pair of pivot shafts that are parallel to each other;

a plurality of braking members each provided to each of the pivot levers, the plurality of braking members being capable of coming into and out of contact with the guide rail through pivotal movement of the pivot levers;

a connecting member pivotally connected to connecting portions of the pivot levers, the connecting portions located on opposite ends of the connecting member along a plane formed by a longitudinal axis of the connecting member; and an electromagnetic actuator configured to push the connecting member in a first direction to pivot the pivot levers in a braking direction to bring the braking members into contact with the guide rail and to pull the connecting member in a second direction to pivot the pivot levers in a releasing direction to bring the braking members out of contact with the guide rail, wherein connecting portions of the connecting member with the pivot levers are arranged on a first side of a plane containing axes of the pivot shafts in a case that the braking members are in contact with the guide rail, and the connecting portions are arranged on a second side of the plane containing the axes of the pivot shafts in a case that the braking members are out of contact with the guide rail.

* * * * *